US008235031B2

(12) United States Patent
Kim

(10) Patent No.: US 8,235,031 B2
(45) Date of Patent: Aug. 7, 2012

(54) SYSTEMS AND METHODS FOR PROVIDING OPERATING PARAMETERS TO A PAINTBALL GUN AND PAINTBALL ACCESSORIES

(76) Inventor: Yong S. Kim, Seoul (KR)

( * ) Notice: Subject to any disclaimer, the term of this patent is extended or adjusted under 35 U.S.C. 154(b) by 419 days.

(21) Appl. No.: 12/558,510

(22) Filed: Sep. 12, 2009

(65) Prior Publication Data

US 2011/0061638 A1 Mar. 17, 2011

(51) Int. Cl.
*F41B 11/00* (2006.01)

(52) U.S. Cl. ..... 124/77; 42/70.11

(58) Field of Classification Search ..... 124/77; 42/70.11

See application file for complete search history.

(56) References Cited

U.S. PATENT DOCUMENTS

| | | | | |
|---|---|---|---|---|
| 5,282,454 | A | 2/1994 | Bell | |
| 5,303,495 | A * | 4/1994 | Harthcock | 42/84 |
| 5,461,812 | A * | 10/1995 | Bennett | 42/70.11 |
| 5,842,300 | A * | 12/1998 | Cheshelski et al. | 42/116 |
| 5,915,936 | A * | 6/1999 | Brentzel | 42/70.11 |
| 6,219,952 | B1 * | 4/2001 | Mossberg et al. | 42/70.01 |
| 6,237,271 | B1 * | 5/2001 | Kaminski | 42/70.06 |
| 6,510,642 | B2 * | 1/2003 | Riener | 42/70.11 |
| 6,609,511 | B2 | 8/2003 | Kotsiopoulos et al. | |
| 7,270,121 | B2 | 9/2007 | Lubben | |
| 7,435,179 | B1 | 10/2008 | Ford | |
| 7,458,370 | B2 | 12/2008 | Chen | |
| 7,921,588 | B2 * | 4/2011 | Brown et al. | 42/70.01 |
| 7,921,835 | B2 * | 4/2011 | Campo et al. | 124/51.1 |
| 2007/0062509 | A1 | 3/2007 | Campo | |
| 2007/0175463 | A1 | 8/2007 | Higgins | |
| 2008/0039962 | A1 * | 2/2008 | McRae | 700/90 |
| 2008/0282595 | A1 | 11/2008 | Clark | |
| 2009/0050126 | A1 | 2/2009 | Higgins | |
| 2009/0101128 | A1 * | 4/2009 | Lian | 124/71 |
| 2009/0255160 | A1 * | 10/2009 | Summers | 42/70.01 |
| 2010/0206282 | A1 * | 8/2010 | Italia et al. | 124/51.1 |
| 2010/0258101 | A1 * | 10/2010 | Campo et al. | 124/51.1 |
| 2010/0281725 | A1 * | 11/2010 | Arbouw | 42/1.02 |
| 2011/0186025 | A1 * | 8/2011 | Campo et al. | 124/51.1 |

* cited by examiner

*Primary Examiner* — Michael David

(74) *Attorney, Agent, or Firm* — Letham Law Firm LLC; Lawrence Letham

(57) ABSTRACT

An electronic device provides parameters to a paintball gun and/or paintball accessories. The gun performs an operation in accordance with the parameters. The accessories respectively perform a function of the accessories in accordance with the parameters. The electronic device does not perform a function of the paintball gun or a function of the accessories.

20 Claims, 11 Drawing Sheets

SYSTEMS AND METHODS FOR PROVIDING OPERATING PARAMETERS TO A PAINTBALL GUN AND PAINTBALL ACCESSORIES

FIELD OF THE INVENTION

Embodiments of the present invention relate to paintball guns, paintball accessories, electronic devices for initializing paintball guns and paintball accessories, and to methods for initializing paintball guns and paintball accessories.

BACKGROUND OF THE INVENTION

Conventional paintball guns and some paintball accessories are controlled by a respective processing circuit that executes a stored program to perform an operation of the paintball gun or paintball accessory. A stored program may perform a function of the paintball gun or the paintball accessory in accordance with a parameter (e.g., variable, data, value). Generally, paintball guns and paintball accessories store default parameters that may be changed (e.g., updated, written, stored, initialized) to control an operation in accordance with the parameter.

BRIEF DESCRIPTION OF THE DRAWING

Embodiments of the present invention are described with reference to the drawing, wherein like designations denote like elements, and.

DETAILED DESCRIPTION OF THE PREFERRED EMBODIMENTS

A conventional paintball gun may include a gun controller and a gun module. A conventional paintball accessory may include an accessory controller and an accessory module. A controller (e.g., gun, accessory) may include a processing circuit, a memory, a control, a display, a transceiver, and an operation interface. A module (e.g., gun, accessory) may include one or more sensors, transducers, electronic devices, electromechanical devices (e.g., solenoid), and/or mechanical devices.

A controller may control many, if not all, operations of a module. A controller may perform an operation of a device (e.g., paintball gun, paintball accessory) by controlling an operation of a module. Controlling an operation of a module includes initializing the module, detecting a present operating condition of the module, and providing a signal to a module. Responsive to control, a module may perform an operation of the module. An operation may include performing a mechanical operation (e.g., moving, translating), performing a pneumatic operation (e.g., providing a pneumatic fluid, retaining a pneumatic fluid, regulating a pneumatic fluid), performing an electromechanical operation (e.g., providing a signal to perform a mechanical operation, detecting a mechanical operation to provide a signal). A signal may include an voltage, a current, an any analog or digital representation of information (e.g., data). One operation (e.g., mechanical, pneumatic, electromechanical) may cause another operation.

Figure 1:
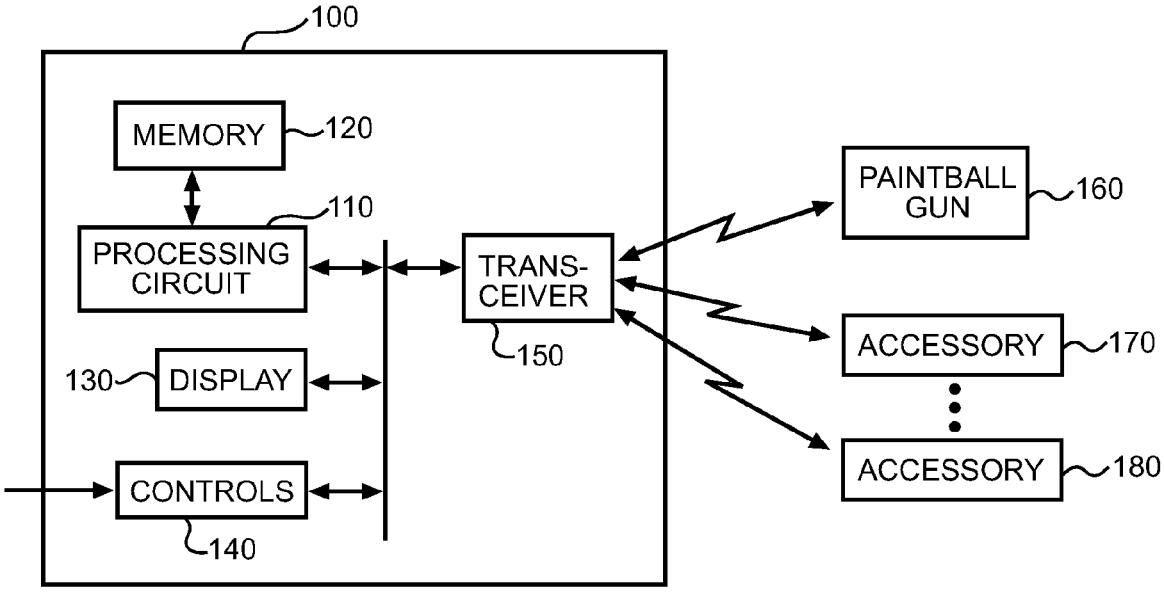
FIG. 1 is a functional block diagram of an electronic device according to various aspects of the present invention for providing parameters of operation.
Figure 2:
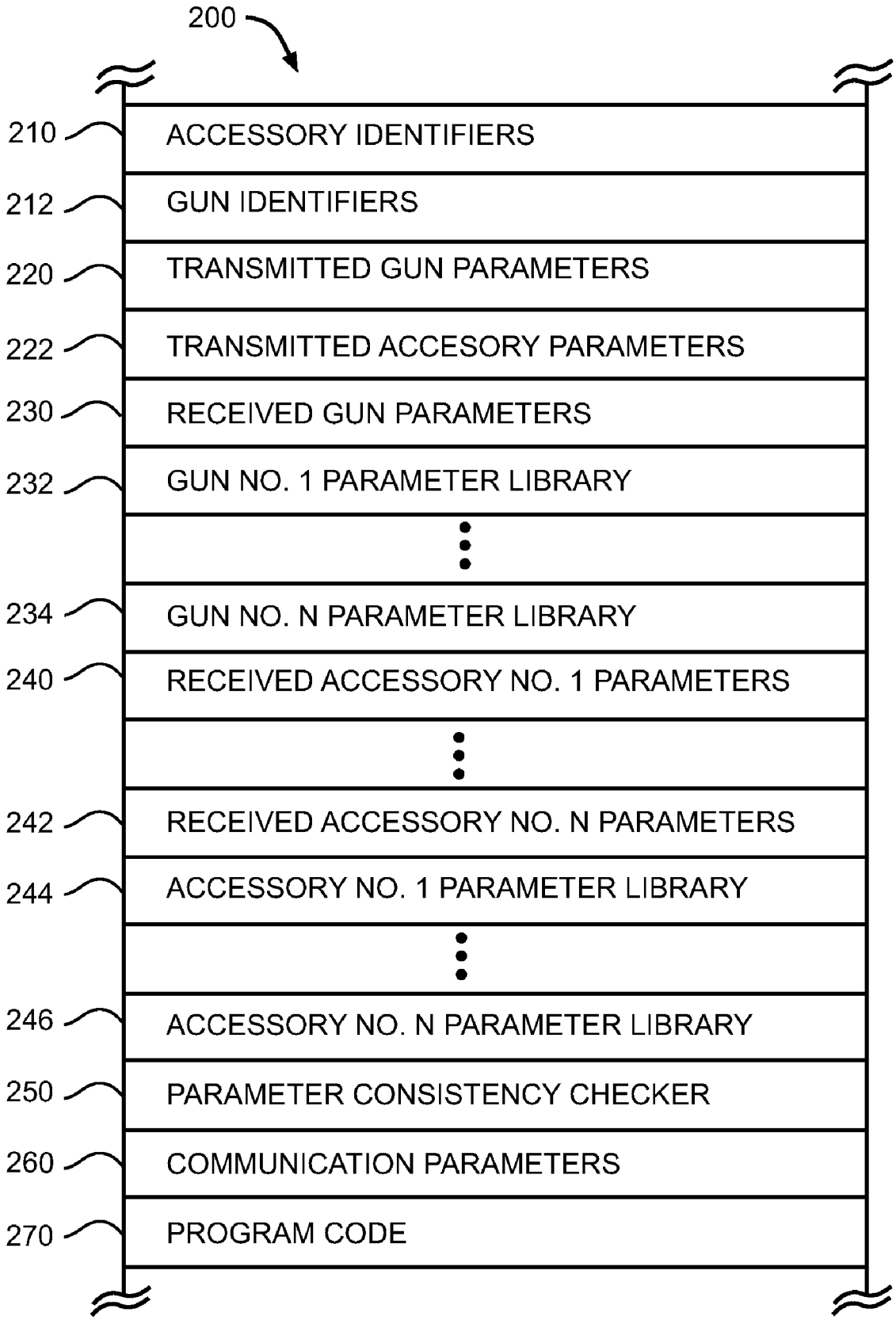
FIG. 2 is a diagram of data stored in a memory of the device of FIG. 1.
Figure 3:
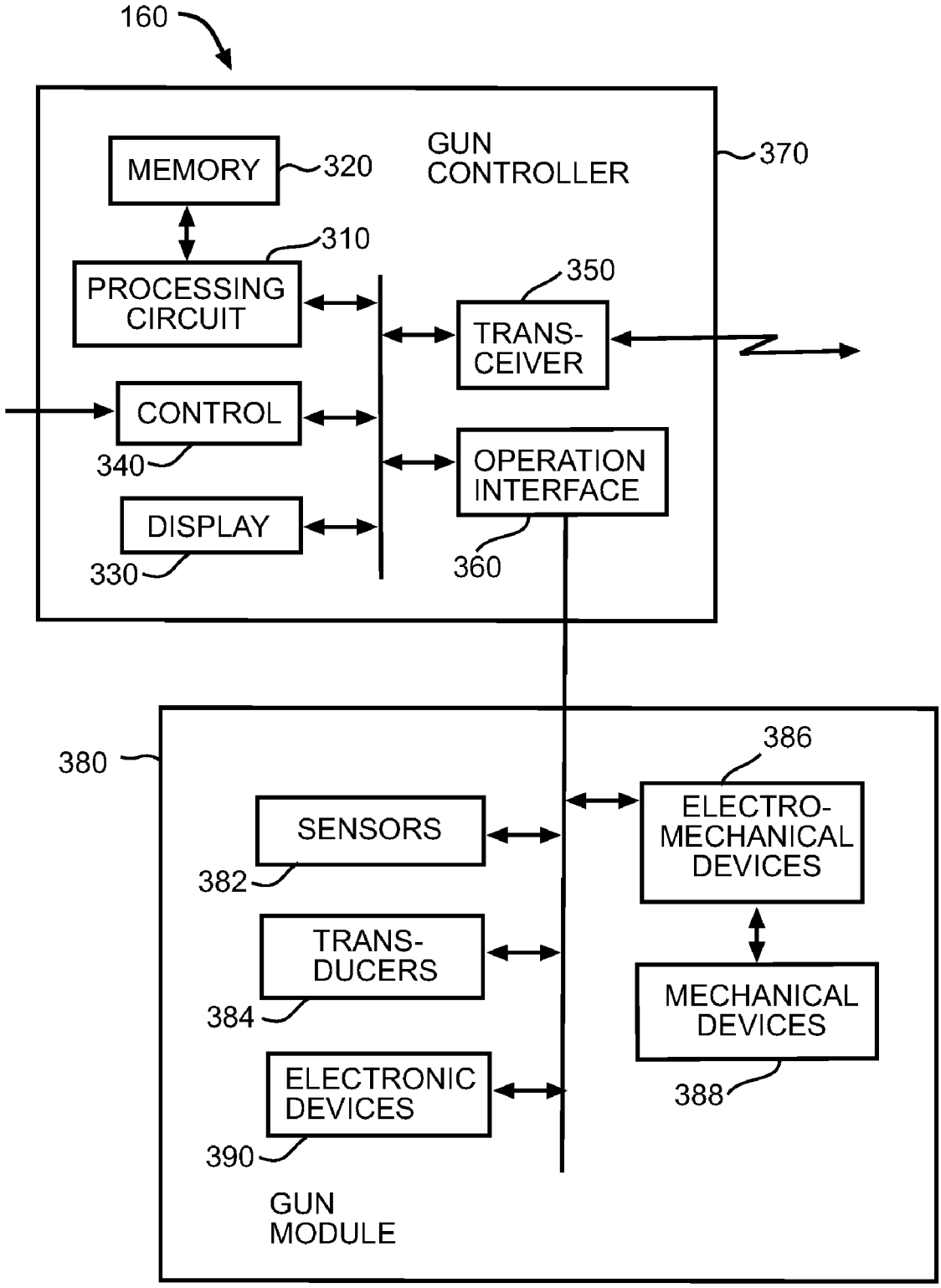
FIG. 3 is a functional block diagram of a paintball gun according to various aspects of the present invention.
Figure 4:
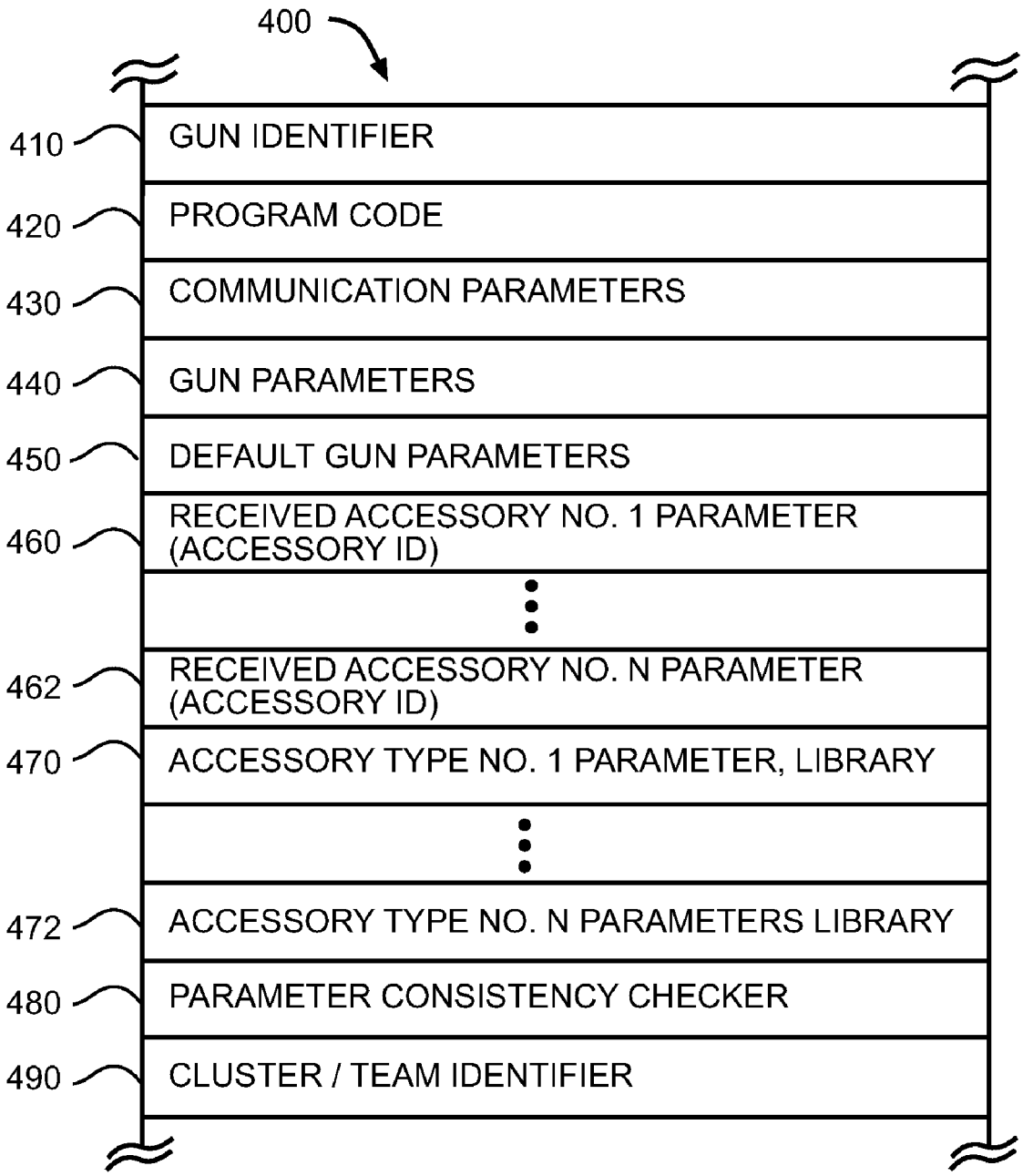
FIG. 4 is a diagram of data stored in a memory of the paintball gun of FIG. 3.
Figure 5:
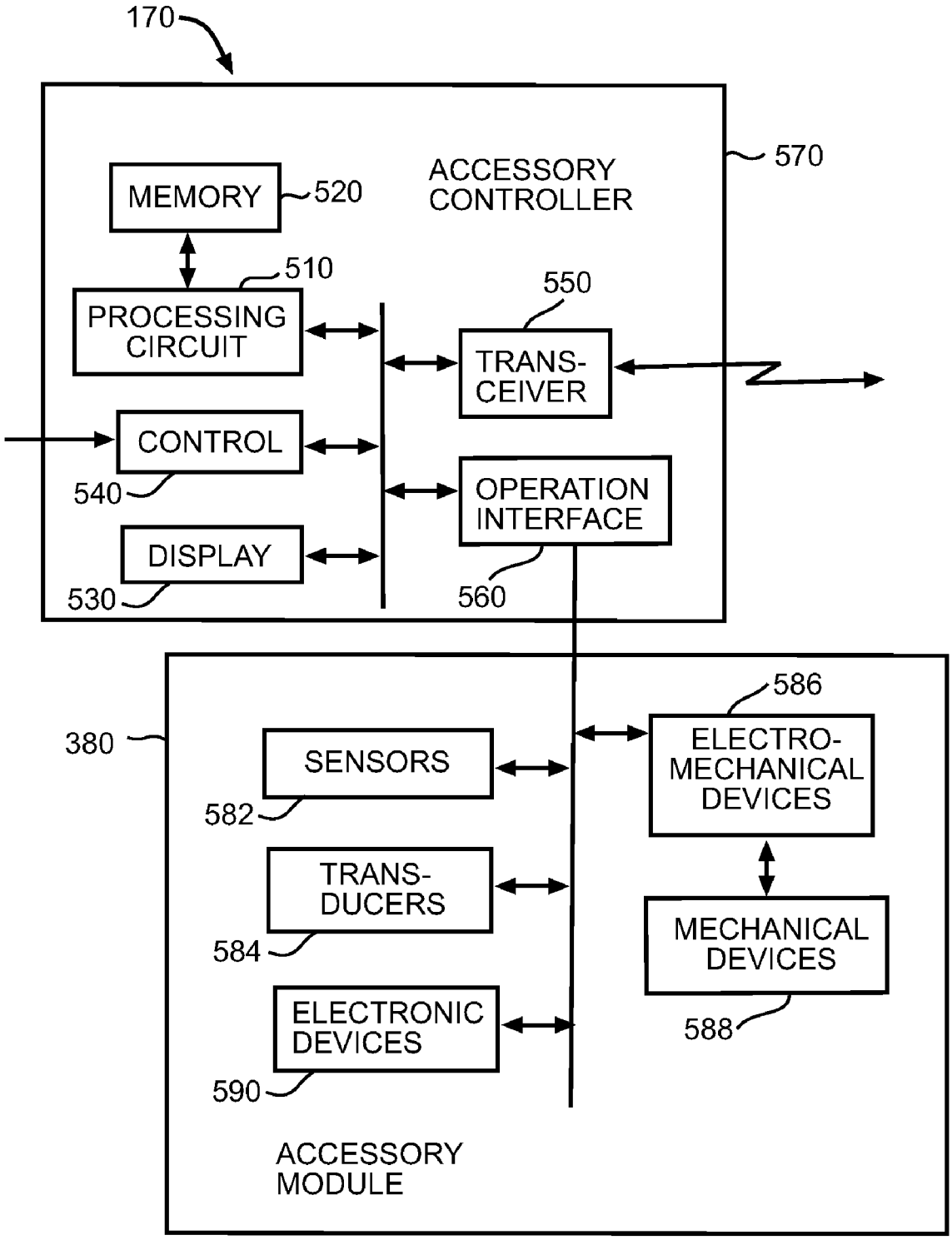
FIG. 5 is a functional block diagram of a paintball accessory according to various aspects of the present invention.
Figure 6:
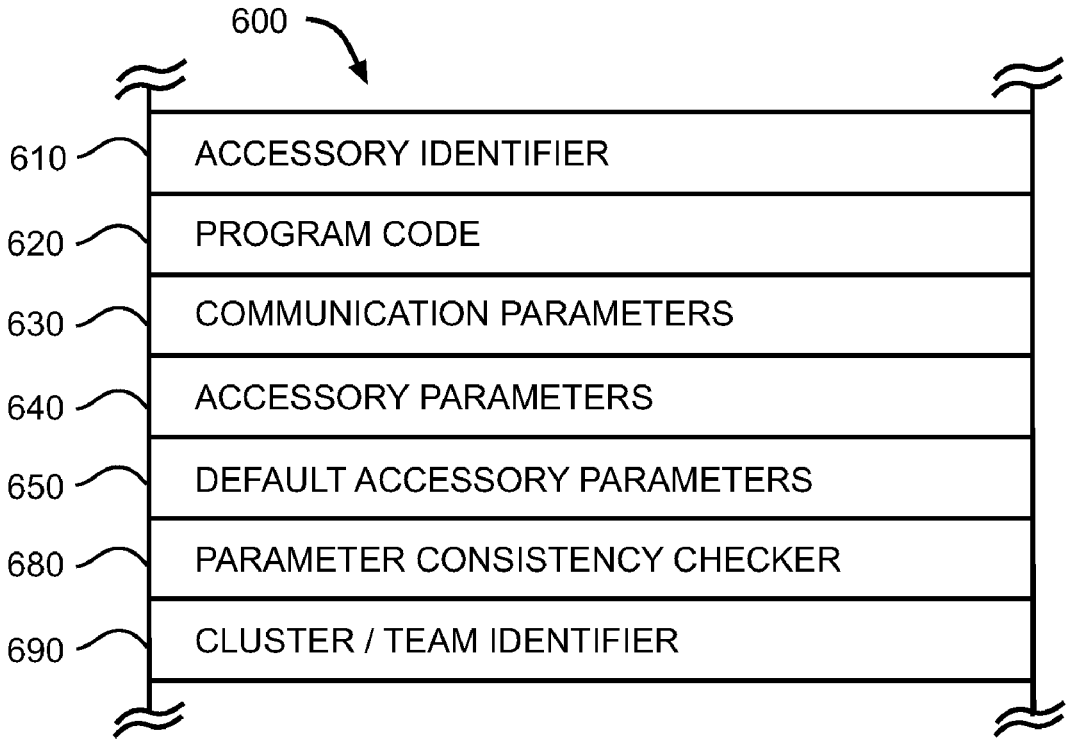
FIG. 6 is a diagram of data stored in a memory of the paintball accessory of FIG. 5.
Figure 7:
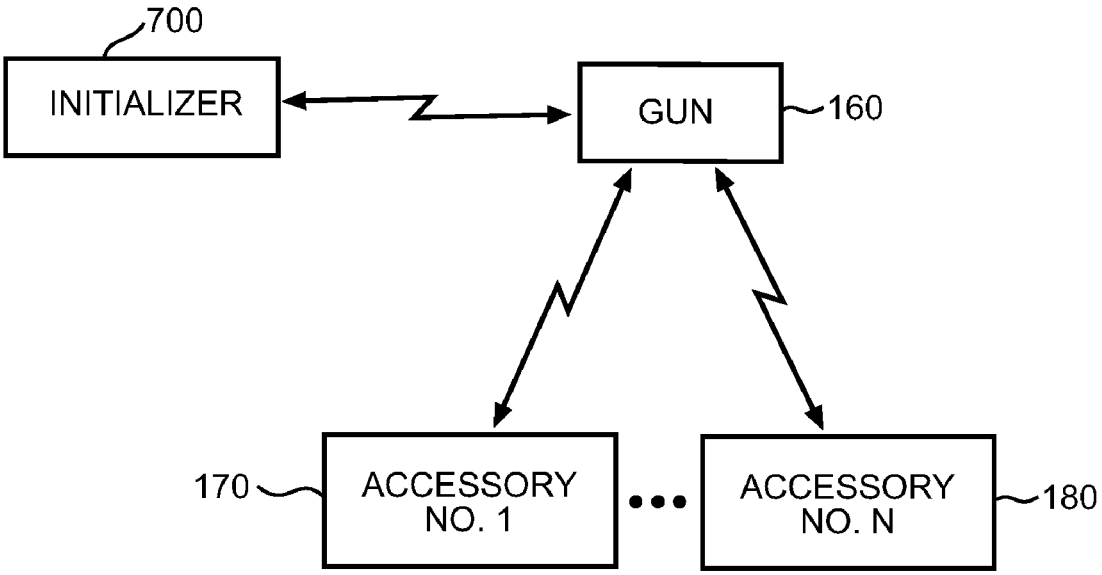
FIG. 7 is another functional block diagram of an electronic device according to various aspects of the present invention for providing parameters of operation.
Figure 8:
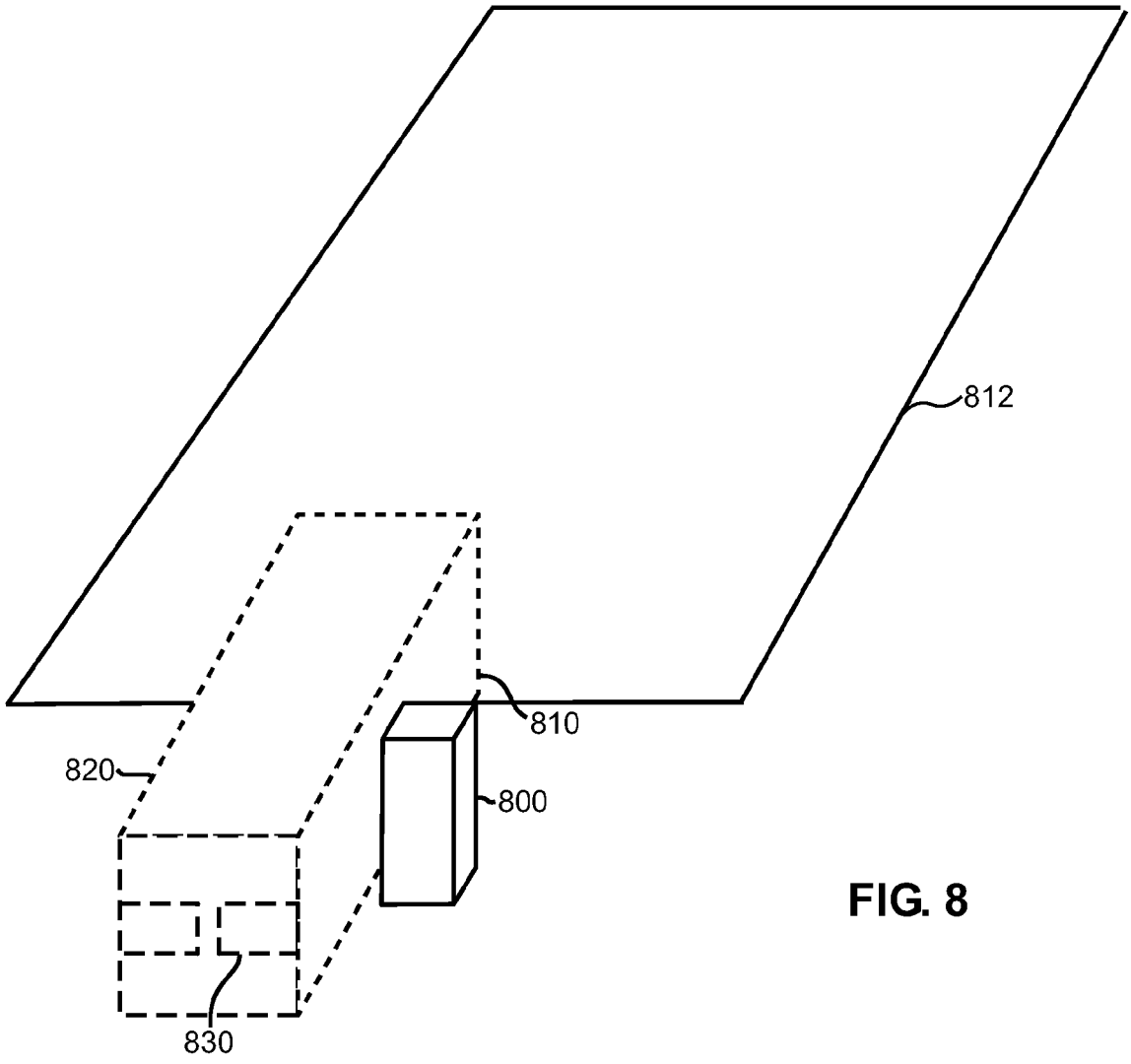
FIG. 8 is an implementation of the electronic device of FIG. 1 or 7 position at an entrance of a playing field for paintball.
Figure 9:
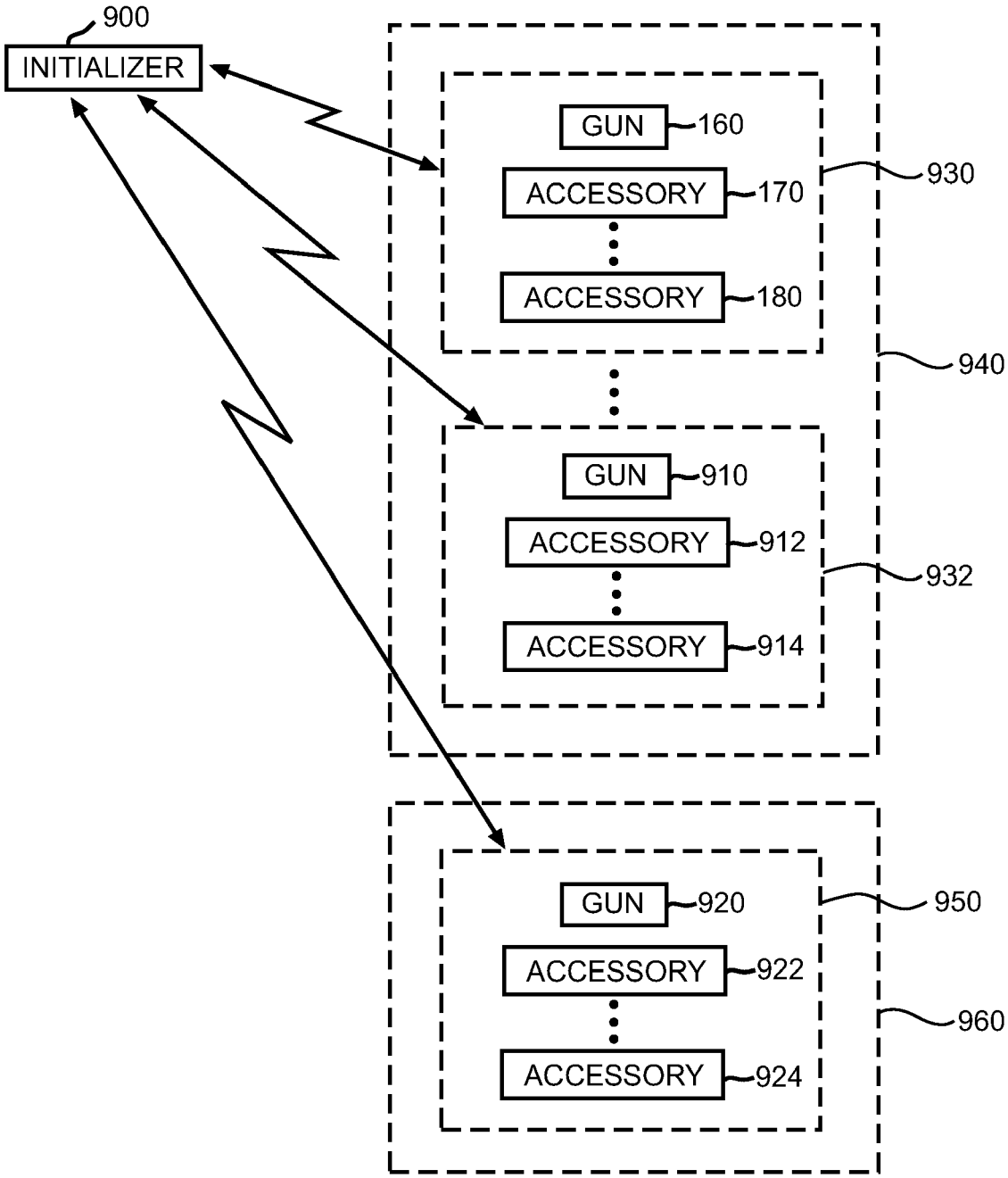
FIG. 9 is the electronic device of FIG. 1 providing parameters to a plurality of guns and accessories.

For example, gun controller 370 of FIGS. 3-4 includes processing circuit 310, memory 320, control 340, display 330, transceiver 350 and operation interface 360. Accessory controller 570 of FIGS. 5-6 includes processing circuit 510, memory 520, control 540, display 530, transceiver 550 and operation interface 560.

A gun controller and a gun module cooperate to perform a function of a gun. An accessory controller and an accessory module cooperate to perform a function of an accessory. An operation of a gun may include launching a paintball, loading a paintball in firing chamber, receiving a paintball from a loader, releasing pressurized gas, and detecting a trigger pull.

An accessory controller and an accessory module cooperate to perform a function of an accessory. An operation of an accessory is in accordance with the purpose of the accessory. One accessory, of many possible accessories, includes a paintball loader. An operation of a paintball loader includes providing a paintball at an exit of the loader, detecting a jammed paintball, and reporting a jammed paintball.

The sensors, transducers, electronic devices, electromechanical devices, and/or mechanical devices of a module cooperate to perform an operation of a gun and/or an accessory. A controller cooperates with a module to perform an operation. A processing circuit of a controller may control an operation. A processing circuit of a conventional paintball gun may control an operation of the gun by controlling (e.g., activating, energizing) the gun module. A processing circuit of a conventional paintball accessory may control an operation of the accessory by controlling (e.g., activating, energizing) the accessory module.

A controller may perform an operation in accordance with a parameter (e.g., variable, data, value). A parameter may alter (e.g., affect, change, vary, modify) a performance of an operation. A parameter may have an initial value. A parameter may change. A parameter may change responsive to an operation. A user may provide a value of a parameter. A parameter may be provided by an independent source (e.g., initializer). A controller may communicate with an initializer. A controller may provide present parameters to an initializer. A controller may receive parameters from an initializer.

An accessory may cooperate with a gun to perform an operation of the gun. An accessory may cooperate with a gun for a convenience of a user of the gun. For example, many conventional paintball guns cooperate with a paintball loader accessory. The gun and the loader include respective controllers and modules. The gun controller performs the operation of launching paintballs from the barrel of the gun. The accessory controller of the loader performs the operation of providing paintballs at an exit of the loader for launching by the gun. The gun controller controls the rate of fire of the gun. The loader controller controls the rate of providing paintballs to the gun. The gun controller and the loader controller may operate independently of each other, yet cooperate to perform a function.

Cooperation between the gun and an accessory improves when an operation of the gun corresponds to an operation of the accessory. An operation of a gun performed in accordance with a parameter may correspond to an operation of an accessory performed in accordance with a parameter when the parameter of the gun is consistent (e.g., compatible) with the parameter of the accessory.

For example, cooperation between a gun and a loader improves when the value of the parameter that controls the rate of fire of the paintball gun and the value of the parameter that controls the rate at which a loader provides paintballs are consistent with each other. A gun that launches paintballs in accordance with a parameter value for a higher rate of launch may better cooperate with a loader that provides paintballs in accordance with a parameter value for a higher rate of providing of paintballs. Cooperation between a gun and an accessory may be maintained if the parameters of the gun and the accessory are maintained consistent. For example, when the value of a parameter of the paintball gun is changed, a change to the value of parameter of the paintball loader may provide continued cooperation between the gun and the loader.

A processing circuit may perform many, if not all, of the operations of a controller. A processing circuit may include conventional microprocessors, signal processors, programmable logic arrays, programmable logic devices, combinatorial logic, sequential logic, synchronous logic, asynchronous logic, input ports, output ports, analog to digital converters, digital to analog converters, and memory.

A memory may include any conventional memory including flip-flops, dip switchs, RAMs, ROMs, EPROMs, and flash memories. A memory may store a stored program for retrieval and executed by a processing circuit to perform an operation of a gun and/or accessory.

A processing circuit may perform an operation of a gun and/or an accessory in accordance with a value of a parameter. A stored program may include parameters that alter execution of the program by the processing circuit in accordance with the value of the parameter. For example, a conventional paintball gun may launch (e.g., fire, propel) paintballs in a semi-automatic, full-automatic, three-round burst, or training mode manner. The manner of launching is selected by providing a value for a parameter (e.g., Firing Mode) to the processing circuit. The processing circuit operates in accordance with the value of the launch parameter to launch paintballs.

Another example of a parameter used by a processing circuit to perform an operation of a paintball gun is the maximum rate of fire parameter. A processing circuit performs a launch operation responsive to an operation of a trigger, but at the rate no faster than the rate prescribed by the maximum rate of fire parameter. As the value of the maximum rate of fire parameter is increased or decreased, the processing circuit adjusts its operation to perform the launch operation of the paintball gun in accordance with the parameter.

A processing circuit may perform an operation in accordance with many parameters. An operation of a gun and/or an accessory may be performed in accordance with a combination of two or more parameters. Parameters may cooperate to control an operation of a gun and/or an accessory. Use of incorrect and/or incompatible parameters may result in non-operation or inconsistent operation of a paintball gun, a paintball accessory, and/or the cooperation of a paintball gun and paintball accessory.

Use of a parameter in a paintball gun that is not compatible with a parameter used in a paintball accessory may preclude cooperation of the paintball gun with the paintball accessory. Accordingly, assignment of parameters to a paintball accessory may need to be coordinated with the parameters assigned to a paintball gun.

For example, many conventional paintball guns cooperate with a paintball loader accessory to perform an operation of the paintball gun. The gun and the loader include respective processing circuits. The processing circuit of the gun performs the operations of loading a paintball into the breech and releasing pressurized gas to launch the paintball from the barrel of the gun. The processing circuit of the loader performs the operation of providing paintballs at an exit of the loader, which is coupled, to an entrance of the breech of the gun. The paintball gun cannot launch a paintball unless the loader provides a paintball.

As discussed above, the processing circuit of the paintball gun controls the rate of fire of paintball gun while the processing circuit of the loader controls the rate of providing paintballs at the exit of the loader. The processing circuits for the gun and the loader may operate independently of each other. Cooperation between the paintball gun and the loader improves when the value of the parameter that controls the rate of fire of the paintball gun and the value of the parameter that controls the rate at which the loader provides paintballs are consistent with each other. A paintball gun that launches paintballs in accordance with a value of a parameter for a higher rate of launch may better cooperate with a loader that provides paintballs in accordance with a value of a parameter for a higher rate of provision of paintballs.

Parameters for a paintball gun as provided in Table 1 below. Each parameter may have a default value that is used to control the operation of the paintball gun until the value of the parameter is changed.

TABLE 1

Paintball Gun Parameters

| Parameter | Operation as per parameter | Default |
|---|---|---|
| Firing Mode | Value: semi auto, PSP ramping 3B, PSP ramping 2, millennium ramping, NXL, user defined ramping, auto response, full auto, full auto/user defined ramping, three round burst, training mode. | Semi auto |
| Debounce | Time between trigger pull and release. Value: 1-30. | 5 |
| Anti Mechanical | Adjust trigger settings to reduce undesired firings of | 3 |

TABLE 1-continued

| Paintball Gun Parameters | | |
|---|---|---|
| Parameter | Operation as per parameter | Default |
| Bounce | paintballs. Value: 1-10. | |
| Ramp Required Pull Number | Required number of pulls to start ramping process. The number of required pulls must be occur at the ramp activation rate. This parameter controls the operation of the paintball gun only when the Firing Mode parameter is set to full auto/user defined ramping. Value: 1-15. | 3 |
| Ramp Activation Rate | The rate of trigger pulls at which ramping is activated. This parameter controls the operation of the paintball gun only when the Firing Mode parameter is set to full auto/user defined ramping. Value: 4-15. | 4 |
| Ramp Sustain Rate | The rate of trigger pulls that maintains ramping. This parameter controls the operation of the paintball gun only when the Firing Mode parameter is set to full auto/user defined ramping. Value: 4-15. | 4 |
| Ramp Percentage | Multiplied by the number of artificial shots activation range. Value: 10%-500%. | 500% |
| Rate of Fire | Rate of fire in balls per second. Value: 5-30. | 12 |
| Rate of Fire Cap | Specifies whether the rate of fire may be exceeded. Value: capped, uncapped. | capped |
| Rate of Fire Sensor | Manual rate of fire with eye sensor disabled. Value: 5-30. | 15 |
| Dwell | Amount of time in milliseconds that the gun solenoid stays open. Value: 5-30. | 18 |
| Anti Bolt Stick | An amount of time added to dwell time to reduce "shot drop off" caused by a sticking bolt. Value: 0-10. | 0 |
| Breech delay time | An amount of time in milliseconds that the eye sensor must stay connected before the breech is considered empty. Value: 1-20. | 5 |
| Eye Delay Time | An amount of time in milliseconds that a paintball must rest in the breech before it is considered ready to fire. A low setting must be used for proper operation of the paintball gun with a forced fed paintball hopper accessory. Value: 1-20. | 3 |
| Auto Shut Down | An amount of time in minutes that a gun control circuit remains on with no activity by the user of the gun. Value: 0-30. | 20 |
| Game Time | An amount of time to complete playing a game. Value: 0-60. | 10 |
| Sound Alert | Enable or disable audio signals from the paintball controller. Value: on or off. | on |
| Ramp Reset Time | An amount of time in milliseconds for resetting the ramp in the PSP ramping 3B, PSP ramping 2, millennium ramping, and NXL firing modes. Value: 500-2000. | 1000 |
| Brightness | Brightness of the OLED display. Value: low, medium, high. | Medium |
| Display Angle | Select whether information is presented on the display in the landscape or portrait format. Value: vertical or horizontal. | Horizontal |
| Boost Screen Timer | Boost time in seconds. Value: 0-3. | 1.5 |
| Factory Reset | Set all parameters to default settings. Value: yes or no. | No. |

Parameters for a paintball loader as provided in Table 2 below. Each parameter may have a default value that is used to control the operation of the paintball gun until the value of the parameter is changed.

TABLE 2

| Paintball Gun Loader Parameters | | |
|---|---|---|
| Parameter | Operation as per parameter | Default |
| Parameter Source | Select parameter source. The loader may use default parameters values or parameters received from another source. Parameters received from another source are communicated using the Communication Mode. Value: default, other. | Default |
| Communication Mode | Select method for communication with a paintball gun. Value: 802.11, Bluetooth, Zigbee, serial. | Bluetooth |
| Loader Address | Select address used by board for communication. Each board is assigned an address by the manufacturer. The | Manu |

TABLE 2-continued

Paintball Gun Loader Parameters

| Parameter | Operation as per parameter | Default |
|---|---|---|
| | board may use the manufacturer address or an address assigned by another device. Values: manufacturer, assigned. | |
| Eye Enable | Select whether the loader detector that detects whether a paintball is positioned in the breech is on or off. Value: on, off. | On |
| Force Feed | Select whether manual force feed is enabled. When enabled, activation of the feed button by a user will force the motor to feed a paintball. Values: on, off. | On |
| Anti-Jam | Method for clearing a jam. A paintball jam may be cleared by allowing the loader to detect the jam and automatically reverse the motor or by permitting manual clearing by user activation of a jam button. Value: automatic, manual | Auto |
| Anti-Jam reverse | Select the number of reverse revolutions made by the motor when clearing a jam whether automatically or manually. Value: 0.5-1.5. | 0.5 |
| Un-Jam Reverse Speed | Select the speed of the motor when operating in reverse to un-jam paintballs. Reverse speed is related to Un-Jam Tension. The higher the un-jam tension, the higher the speed may be set. Values: 1-5 (fast). | 2 |
| Feed Tension | Tension specifies the pressure applied to paintballs in the back-stack. Higher tension decreases response time of the loader. Tension must be increase to provide paintballs at a higher rate. However, increase tension increases paintball breakage. Higher tension also decreases battery life. Value: 0 (none, e.g., gravity feed)-11 (high). | 3 |
| Auto Tension Decrease | Feed Tension may be automatically decrease when the gun does not launch paintballs. When the hopper detects that the gun has not fire a paintball and thus the hopper has not had to feed a paintball, for a time, the tension on the back-stack is automatically decreased to reduce paintball breakage and increase battery life. Selecting a slow decrease keeps the loader ready to provide paintballs when the gun resumes shooting. Selecting a slow fast decrease increases battery life, but adds latency when the gun begins to shoot and additional latency to return to high rate firing. Values: 0 (no reduction in pressure)-10 (fast). | 4 |
| Un-Jam Tension | Select the pressure applied to paintballs when un-jamming. Value: 0 (none, e.g., gravity feed)-11 (high). | 2 |
| Battery Display | Display battery level. Value: on, off. | On |
| Paintball Quantity | Number of paintballs loaded into an empty loader (e.g., number of paintballs in hopper at reload). This value is used to track the number of paintballs remaining in the loader. Value: 100-500. | 180 |
| Feed Rate | Paintball feed rate. Value: 15-35. | 20 |

Because of increasing complexity of the electronics of guns and/or accessories, more parameters may be programmed to control operation of the gun and/or accessory. Achieving cooperation between a gun and/or accessories requires greater coordination between the values of parameters assign to guns and/or accessories.

A user of a paintball gun and paintball accessories may benefit from a device that provides parameters and/or a method for providing parameters a paintball gun and/or a paintball accessory. A user may further benefit from a device and/or a method for detecting whether an operation of the paintball gun performed in accordance with a first parameter cooperates with an operation of an accessory performed in accordance with a second parameter. A user of a paintball gun and/or accessory may further benefit from a device that detects whether the values of the parameters selected for a gun or an accessory provide consistent operation for that gun or accessory.

A device for providing parameters (e.g., an initializer), according to various aspects of the present invention, provides parameters to a paintball gun and/or a plurality of paintball accessories for controlling an operation of the gun and/or the accessories respectively.

An initializer may store parameters for paintball guns and/or paintball accessories. An initializer may organize parameters for storage, access, and comparison. An initializer may store, access, and/or modify parameters using any conventional database structures, commands and/or software. An initializer may store parameters for many different types of guns and/or accessories. An initializer may organize parameters by type, manufacturer, model, version of gun, accessory, and/or controller. An initializer may store information (e.g., parameters, data, value, signal, identifier) received for a gun and/or accessory.

An initializer may communicate with a gun and/or an accessory. Communication may include sending and receiving information. An initializer may communicate with a single gun or single accessory at any one time. An initializer may provide (e.g., broadcast) parameters to many guns and/or accessories simultaneously.

An initializer may identify a gun or accessory using an identifier (e.g., number, alphanumeric string, encoded signal, communication address, manufacturer identification number, unique serial number, model number). An initializer may receive an identifier from a gun, an accessory, a manufacture and/or a user. An identifier may be visually displayed (e.g., LCD display, LED display, printed label) on a gun and/or an accessory. A user may detect the identifier displayed on the gun or accessory and provide the identifier to an initializer. An initializer may store an identifier of guns and/or accessories. An identifier may organize guns and/or accessories by their respective identifier. An initializer may index gun and/or accessory information using an identifier. An initializer may form groupings of guns and/or accessories. A grouping of guns and/or accessories may form groups (e.g., clusters, teams) of guns and/or accessories that may operate in a coordinated manner.

An initializer may communicate using any conventional protocol and communication medium. An initializer may communicate using a wired (e.g., TCP/IP, USB, 1394) or wireless (e.g., Bluetooth, IEEE 802.11a/b/g/, Zigbee) connection. An initializer may form a hierarchy of communication. A hierarchy of communication may establish communication between some guns and/or accessories, but not other guns and/or accessories. A hierarchy of communication may establish communication between a single gun and one or more accessories. A hierarchy of communication may included an initializer communicating to an accessory via a gun or visa versa. An initializer may use identifiers for guns and/or accessories to form a hierarchy of communication.

An initializer may detect a type, manufacturer, and/or model of a gun and/or an accessory. An initializer may receive a list of parameters employed by a gun and/or an accessory. An initializer may receive a value for each parameter presently used by a gun and/or accessory. An initializer may receive a definition of an acceptable range of values for a parameter. An initializer may store parameter values received from a gun and/or an accessory. An initializer may modify parameter values received by a gun and/or an accessory. An initializer may compare received parameter values to stored parameter values.

An initializer may, according to various aspects of the present invention, detect the compatibly of parameters for a gun and/or an accessory. An initializer may detect parameters for a gun and an accessory that may provide inconsistent cooperation between the gun and the accessory. An initializer may provide a notice upon detecting an incompatibility between a gun parameter and an accessory parameter. A notice may include an audible warning, a visual display, and a mechanical performance (e.g., vibration).

An initializer may be separate from paintball guns and/or paintball accessories. An initializer may perform the functions of an initializer, but not perform or control performance of an operation of a gun and/or an accessory. An electronic device may perform a primary function (e.g., cell phone, PDA, mobile computer, net book) other than operation of a gun and/or accessory and further perform the functions of an initializer. An initializer that is separate from a gun and accessories may communicate with the gun and accessories using a wired or wireless coupling; however, the communication does not perform a operation of and/or control an operation of the gun and/or accessory. An initializer may provide a parameter value and a gun and/or accessory controller may perform an operation of the gun and/or accessory in accordance with the parameter value, but an initializer may not control an operation of the gun and/or accessory.

The functions of an initializer as discussed herein may be performed by a gun controller. A gun controller may perform the functions of an initializer and perform an operation of the gun.

The functions of an initializer as discussed herein may be performed by an accessory controller. An accessory controller may perform the functions of an initializer and perform an operation of the accessory.

The functions of an initializer as discussed herein may be performed by an initializer, but an initializer may not perform a operation of a gun and/or an accessory.

The functions of an initializer may be performed in a hierarchical manner. For example, an initializer that is separate from guns and accessories may perform the functions of an initializer while proximate (e.g., within wireless communication range) to a gun and/or an accessory. When a separate initializer is not proximate, the functions of an initializer may be performed by a gun controller. Performance of the functions of an initializer by a gun controller may be limited to initializing accessories for cooperation with the gun, but not other guns or accessories that cooperate with other guns.

For example, initializer 100, 700, 800, and 900 of FIGS. 1 and 7-9 perform the functions of an initializer as discussed herein. Initializer 100, 700, 800, and 900 are devices that are separate from paintball guns and/or paintball accessories. Initializer 100, 700, 800, and 900 may perform a primary function in addition to the functions of an initializer.

Initializer 100 may include processing circuit 110, memory 120, display 130, controls 140, and transceiver 150. Initializer 700, 800, and 900 may include a processing circuit, a memory, a display, controls, and a transceiver (not shown).

A processing circuit may include the structures and elements of the processing circuit described above. A processing circuit may perform the functions of the processing circuit described above. A processing circuit may communicate with, control, and/or perform all or a part of the functions of a memory, a display, controls, and/or a transceiver.

A memory may include the structures and elements of the memory described above. A memory may perform the functions of the memory as described above. A memory may store and/or provide any or all of the parameters, parameter values, and information (e.g., data, values, parameters, parameter values) described herein. A memory may cooperate with a processing circuit to store, retrieve, and organize information as described above. A processing circuit may cooperate with a memory to organize information as described herein.

A display provides a presentation. A user may view the presentation provided by a display. A display may provide a presentation of parameters, parameter values, and/or information. A display may cooperate with a processing circuit to provide a presentation of information retrieved from a memory, received via a transceiver, and/or receive via controls. A display may further provide audio information. Audio information may inform or instruct a user. A display may provide a presentation of identifiers of a gun and/or accessories. A display may present communication parameters.

Controls may be manually operated by a user of the initializer. A user may provide information to the initializer via the controls. A user may operate controls responsive to a presentation of information on the display. A user may operate a control response to an audio instruction from a display. Controls may include a touch-screen display, buttons, levers, and switches.

A transceiver wirelessly communicates. A transceiver transmits information. A transceiver receives information. A transceiver may transmit and/or receive using any conventional wireless communication protocol, any conventional channel (e.g., frequency, time division, frequency division, spread spectrum, frequency-hopping, frequency-hopping spread spectrum), and any conventional antennas (e.g., omni-directional, directional, beam).

Functions performed by a processing circuit include receiving information from one or more paintball guns, sending information to one or more paintball guns, receiving information from one or more paintball accessories, sending information to one or more paintball accessories, verifying that parameter values for a gun provide consistent and/or proper operation of the gun, verifying that parameter values for an accessory provide consistent and/or proper operation of the accessory, verifying that parameter values for a gun and one or more accessories provide consistent and/or proper cooperation between the gun and the accessories, and comparing parameters previously sent to a gun and/or accessory to parameters received from a gun and/or accessory.

Verifying parameters for consistent operation of a gun and/or accessory includes comparing parameter values, verifying that a value of a first parameter falls within a range in accordance with the value of one or more other parameters, establishing a range of parameter values that provide consistent operation of the gun and/or an accessory for each value of other parameters, establishing tables (e.g., templates) of acceptable values, establishing preferred parameter values, verifying that a value of a first parameter for a gun falls within a range in accordance with the value of one or more parameters of an accessory, and monitoring (e.g., detecting, measuring) operation of a gun and/or accessory for a parameter setting.

For example, for each value of a parameter provided in Table 1 above, a processing circuit may verify that the value of the parameter lies with in a range that provides consistent operation of the gun with respect to the values of the other parameters. For example, referring to the parameters of Table 1, if the value for the parameters Dwell, Anti Bolt Stick, Breech Delay Time, and Eye Delay Time are set to their maximum values of 30 ms, 10 ms, 20 ms, and 20 ms respectively, the maximum firing rate of the gun is about 12.5 paintballs per second ("bps"). Thus, processing circuit 110 verifies that the value for rate of fire lies within the range of 5-12 bps. As the values for the parameters Dwell, Anti Bolt Stick, Breech Delay Time, and Eye Delay Time change, processing circuit 110 determines an acceptable range for Rate of Fire.

In another example, refereeing to the parameters of Table 2, if the value of Un-Jam Tension is low, a high value for Un-Jam Reverse Speed will not provide a quick response to a jam. Further, if the Anti-Jam Reverse is set for a high number of revolutions and the Un-Jam Tension is set to a high value, paintball breakage may be high. Further, if the Feed Rate value is high and the Auto Tension Decrease is high, the tension on the back stack may be release to quickly between paintball launches that the feed rate cannot be sustained.

In an implementation, processing circuit 110 cooperates with memory 120, display 130, controls 140, and transceiver 150 to perform the functions of initializer 100, 700, 800, or 900. Processing circuit 110 may store and retrieve information in and from memory 120. Processing circuit may receive information from controls 140 and transceiver 150 for storage in memory 120. Processing circuit 110 may perform a function in accordance with information received. Processing circuit may provide information to display 130 for presentation.

Information 200 stored by memory 120 may include accessory identifiers 210; gun identifiers 212; parameters 220 transmitted to a gun; parameters 222 transmitted to one or more accessories; parameters 230 received from a gun; parameters 240-242 received from one or more accessories; library 232-234 of parameters for one or more guns (e.g., type, manufacturer, model); library 244-246 of parameters for one or more accessories (e.g., type, manufacturer, model); parameter consistency check 250 for performing a consistency check for parameters of a gun and/or accessories; parameters 260 for communication with guns, accessories, and other initializers; and program code 270.

A gun identifier may include a gun type, a manufacturer of the gun, a model of the gun, a control board type for the gun, a manufacturer of the control board for the gun, and an identifier as described above.

An accessory identifier may include an accessory type, a manufacturer of the accessory, a model of the accessory, a function performed by the accessory, a control board type for the accessory, a manufacturer of the control board for the accessory, and an identifier as described above.

Parameters transmitted to a gun may include parameter values transmitted to a gun. Parameters may include any information used by a gun to perform an operation of the gun. Parameters may be checked (e.g., consistency checker) to verify that the parameters provide consistent operation of the gun and/or consistent cooperation of the gun with one or more accessories.

Parameters transmitted to an accessory may include parameter values transmitted to one or more accessories. Parameters may include any information used by an accessory to perform an operation of the accessory. Parameters may be checked (e.g., consistency checker) to verify that the parameters provide consistent operation of the accessory and/or consistent cooperation of the accessory with a gun and/or one or more accessories.

Parameters received from a gun and/or an accessory may include parameters received prior to sending parameters to the gun and/or accessory. Parameters received from a gun and/or an accessory may include parameters received after sending parameters to the gun and/or the accessory to detect any changes to parameter values. Parameters received from a gun and/or an accessory may include an identifier of the gun and/or accessory. An identifier stored with a received parameter may identify the gun and/or accessory that provided the parameter.

A library of gun parameters may include parameters for guns organized by type, model, gun manufacturer, and control board manufacturer. A library may include a description of parameters for each type, model, and/or manufacturer. A library may include a default value for parameters for each type, model, and/or manufacturer. A library may include one or more templates (e.g., set of values for parameters) that have a value for each parameter. Parameter values of a template may be verified to provide consistent operation. Templates may be created for different situations of use (e.g., tournament, recreation, scenario, speedball, woodsball, extreme, indoor, league, professional). Parameter values in templates for guns and/or accessories may be verified in advance for a particular situation so that upon detecting the situation (e.g., user input, signal, coded signal) parameters may be provided from templates for specific guns and accessories without further verification.

A parameter consistency checker may include data and rules for verifying (e.g., checking) parameters for consistent operation of a gun and/or accessories. Rules may include a description of actions performed to verify consistency. Rules may be stored in a gun library and/or an accessory library for organization by type, model, and/or manufacturer.

Communication parameters may include data used to communicate with a gun and/or accessories. Parameters may depend on the communication protocol and medium used for communication. Communication parameters may include parameters that are specific to a gun and/or an accessory. Communication parameters may include parameters that are common to many guns and/or many accessories. A processing circuit and/or a transceiver may use communication parameters to perform communication. A display may present a presentation of communication options for selection by a user. A user selection may determine a communication parameter. Communication parameters may be selected to provide communication between one gun and one or more accessories. Communication with a gun and one or more accessories may be exclusive to that gun and those accessories for a time.

Program code includes instructions read by a processing circuit for performing a function. Program code controls performance of the functions of the processing circuit.

For example, an initializer may set communication parameters to communicate with one gun and one accessory to the exclusion of all other guns and all other accessories during an initialization period. After the initialization period, the initializer may set communication parameters to communicate with a different gun and different accessories. An initializer may set communication parameters for communication with a particular gun and particular accessories responsive to a user operation of a control. An initializer may provide a presentation to a user of all guns and/or accessories available for selection by a user. An initializer may select parameters that permit communication with any gun and/or accessory, but limit communication to a proximate gun and/or proximate accessories.

Proximity may include physical proximity and/or radio wave proximity. A shield that reduces a signal strength of a radio signal may be used to reduce a range of a radio wave between guns and accessories thereby enhancing communication with only guns and/or accessories that are physically proximate. A physical area may be designated as an initialization area. A gun and/or accessory inside the area may communicate with an initializer. A gun and/or accessories outside of the area cannot communicate with the initializer because they are beyond a communication range of the initializer. A gun and accessories that are to cooperate with the gun may be place in the initialization area to be programmed without interference from other guns and/or accessories. Communication between an initializer, guns, and accessories may be controlled by permitting only one gun and its accessories in the initialization area at any given time.

A controller and a module may perform an operation of a gun and/or an accessory in any conventional manner. A controller may perform an operation of a gun and/or an accessory though controlling (e.g., activating, receiving a signal, sending a signal, reading, writing, sensing, detecting) a function of electromechanical devices (e.g., solenoids), sensors (e.g., optical, mechanical), transducers (e.g., electrical to mechanical, optical to electrical), electronic devices, and mechanical devices. An operation of a gun may include the operations and/or functions described above for a gun. An operation of an accessory may include the operations and/or functions described above for an accessory.

Processing circuit 310 and 510 may perform the functions and/or include the elements of the processing circuit discussed above. Memory 320 and 520 may perform the functions and/or include the elements of the memory discussed above. Display 330 and 530 may perform the functions and/or include the elements of the display discussed above. Control 340 and 540 may perform the functions and/or include the elements of the control discussed above. Transceiver 350 and 550 may perform the functions and/or include the elements of the transceiver discussed above.

Information 400 stored by memory 320 may include gun identifier 410; program code 420; parameters 430 for communication with accessories and an initializer; gun parameters 430 for controlling an operation of the gun; default gun parameters 440; parameters 460-462 received from one or more accessories; library 470-472 of parameters for one or more accessories (e.g., type, manufacturer, model); parameter consistency check 480 for performing a consistency check for parameters of a gun and/or accessories; and cluster/team identifier 490.

Information 600 stored by memory 520 may include accessory identifier 610; program code 620; parameters 630 for communication; accessory parameters 630 for controlling an operation of the accessory; default accessory parameters 640; parameter consistency checker 680 for performing a consistency check for parameters of a gun and/or accessories; and cluster/team identifier 690.

A gun identifier includes an identifier as discussed above. An identifier may be unique. A unique identifier uniquely identifies a gun. A unique identifier distinguishes one gun from all other guns. A unique identifier may also distinguish one gun from all other accessories. A unique identifier may include information for determining the type, model, manufacturer, and date of manufacture of the gun and/or the type, model, manufacturer, date of manufacture, and version of gun controller. A gun identifier may cooperate with communication parameters to establish communication with a single gun.

An accessory identifier may be unique to an accessory as described above with repsec to a gun.

A gun identifier and the identifier of one or more accessories may cooperate with their respective communication parameters to establish a cluster. A cluster may uniquely associate a gun and one or more accessories. A gun and accessories of a cluster may communicate with each other. A gun and accessories of a cluster may communicate with each other without disruption from the communication of other guns and/or other accessories. A cluster may be assigned a unique cluster identifier. One or more clusters may be assigned to a team. Guns and accessories of a team may be assigned a unique team identifier. An initializer may provide a cluster and/or a team identifier. An initializer may use a cluster identifier to identify a gun and accessories that should cooperate so that the parameter values provided to the gun and the accessories of the cluster are consistent. An initializer may use a team identifier to provide consistent parameters to related clusters.

A cluster and/or team identifier may be changed from time-to-time. A cluster identifier and/or a team identifier may be assigned for an event (e.g., tournament, game, round). For example, a cluster identifier may be assigned at the time an initializer provides parameters to a gun and one or more accessories. A cluster identifier may persist as long as the same gun and accessories are associated with each other. A team identifier may be provided prior to an event and disable after an event. A team identifier may change for a new event.

Program code 420 and 620 may include the functions of program code as discussed above. Parameters 430 and 630 for communication include the functions of parameters for communication as discussed above. Gun parameters 440 include the parameters and the operations related to a parameter as discussed above. Performance of an operation of a gun is in accordance with gun parameters 440. Gun parameters 440 may be received from an initializer. Accessory parameters 640 include the parameters and the operations related to a parameter as discussed above. Performance of an operation of an accessory is in accordance with accessory parameters 640. Accessory parameters 640 may be received from an initializer. Default gun parameters 450 and default accessory parameters 650 include any preset value for a parameter.

Parameters 460-462 may inlcude parameters received from one or more accessories. Parameters 460-462 include the accessory parameters and functions of accessory parameters as discussed above. Parameters 460-462 may be received by an initializer and provided to a gun for storage in memory 320. An initializer may request that an accessory provide its parameters and parameter values to the initializer. When gun controller 370 performs the functions of an initializer, gun controller 370 may receive the parameters and parameter values of one or more accessories.

Parameter consistency checker 480 and 680 may include the functions of verifying a parameter and checking a consistency of a parameter as discussed above. A parameter consistency checker may include stored code executed by a processing circuit to perform consistency check for parameters. A parameter consistency checker may perform the functions described herein to verify consistency of parameters.

Cluster identifiers 490 and 690 may include a unique identifier of associated guns and accessories. Team identifiers 490 and 690 may include a unique identifier for associated clusters. A team identifier may further include each of cluster identifier associated with the team.

An operation interface may receive a signal (e.g., voltage, current, optical, magnetic, data, information, value) from a processing circuit, a control, and/or a transceiver. An operation interface may provide the signal, with or without transforming the signal, to a gun module or an accessory module. A gun module or an accessory module may perform an operation of the gun or the accessory respectively responsive to the signal.

A gun and/or accessory module may include sensors, transducers, electronic devices, electromechanical devices, and mechanical devices. A module may communicate with a controller via the operation interface. A module may receive a signal from a controller. A module may provide a signal to a controller. A controller may perform an operation responsive to a signal.

A sensor may detect a physical property (e.g., pressure, temperature, mass, charge). A sensor may detect an occurrence of an event (e.g., movement, change in a physical property). A sensor may provide information response to detecting. A sensor may include any conventional sensor.

A transducer may detect a physical property and/or occurrence. A transducer may provide a signal responsive to detecting. A transducer may include any conventional transducer.

An electronic device may include any conventional electronic device for storing, receiving, providing, computing, calculating, and converting conventional electrical signals.

An electromechanical device includes any electromechanical device (e.g., solenoid, relay, actuator, motor) that receives an electrical signal and performs a mechanical action (e.g., moving, ceasing moving, opening, closing, sealing).

Mechanical devices include any mechanical device (e.g., gears, linkages) and/or structure that performs a function responsive to a mechanical stimulus (e.g., motion).

For example, gun module 380 includes sensors 382, transducers 384, electronic devices 390, electromechanical devices 386, and mechanical devices 388. Accessory module 580 includes sensors 582, transducers 584, electronic devices 590, electromechanical devices 586, and mechanical devices 588.

As discussed above, an initializer may communicate with a paintball gun and/or paintball accessories. In one implementation, initializer 100 communicates with paintball gun 160 and accessories 170-180.

As discussed above an initializer, according to various aspects of the present invention, may provide parameters to a gun and/or one or more accessories. In one implementation, initializer 100 provides parameters to gun 160, accessory 170, and accessory 180. In one method for providing parameters, initializer 100 receives gun identifier 410 from gun 160 via transceiver 350 and transceiver 150. Initializer 100 stores gun identifier 410 in gun identifiers 212 of memory 120. Initializer further receives accessory identifier 610 from accessories 170 and 180 via their respective transceivers. Initializer 100 stores accessory identifiers 610 from each accessory respectively in accessory identifiers 212 of memory 120. Initializer 100 may further provide accessory identifiers 610 to gun controller 370 for storage in received accessory parameters 460-462.

Initializer 100 may use gun identifiers 212, accessory identifiers 210, gun library 232 and accessory library 244-246 to determine the parameters and parameter values available for gun 160 and accessories 170 and 180. Initializer 100 selects parameters values for gun 160 and accessories 170 and 180. Initializer 100 sends the selected parameters to gun 160 and accessories 170 and 180.

Gun 160 receives and stores the gun parameters provided by the initializer in gun parameters 440. Gun 100 performs an operation of gun 160 in accordance with the parameters received from initializer 100. Gun 160 may acknowledge the receipt of the parameters to initializer 100.

Accessories 170 and 180 receive and store the respective accessory parameters provided by the initializer in their respective accessory parameters 640. Accessory 170 and/or accessory 180 may acknowledge the receipt of the parameters to initializer 100. Accessory 170 performs an operation of accessory 170 in accordance with the parameters received from initializer 100. Accessory 180 performs an operation of accessory 180 in accordance with the parameters received from initializer 100. Gun 160 and accessories 170 and 180 may cooperate to perform one or more functions.

Initializer 100 does not perform a function of gun 160 or accessories 170 and 180. Initializer 100 does not access or control operation interface 360 or operation interface 560 of accessories 170 and 180 respectively. Initializer 100 provides parameters to gun 160 and accessories 170 and 180. Controller 370 of gun 160 and respective controllers 570 of accessories 170 and 180 perform the functions of gun 160 and accessories 170 and 180 respectively in accordance with the parameters received from initializer 100.

An initializer may receive information from a user to select parameters for gun 160 and accessories 170 and 180. Information from a user may include some, but not all, values for parameters of gun 160 and accessory 170-180 or values for all parameters of gun 160 and accessory 170-180.

In one implementation, processing circuit 110 of initializer 100 receives present parameters and parameter values (e.g., gun parameters 440) from gun 160 and present parameters and parameter values (e.g., accessory parameters 640) respectively from accessories 170 and 180. Processing circuit 110 stores the received parameters and/or parameter values in received gun parameters 230. Processing circuit 110 stores the received accessory parameters and/or parameter values 242 and 242. Processing circuit 110 presents a presentation of gun parameters and parameter values 230 and accessory parameters and parameter values 240 and 242 to a user via display 130. A user may select using controls 140 values for some or all parameters. Processing circuit 110 sends the parameters as modified by the user to paintball gun 160 and accessories 170 and 180 via transceiver 150. Processing circuit 110 may further store the parameters sent to gun 160 in transmitted gun parameters 220 and/or the parameters sent to accessory 170 and/or accessory 180 in transmitted accessory parameters 222.

At any time after transmitting parameters to gun 160 and/or accessories 170 and 180, initializer 100 may request that gun 160, accessory 170, and/or accessory 180 transmit its present parameters (e.g., 440, 640, 640 respectively). Initializer 100 may receive parameters from gun 160, accessory 170, and/or accessory 180. Initializer 100 may compare the present parameters to transmitted gun parameters 220 and transmitted accessory parameters 222 respectively to determine whether the parameters of gun 160, accessory 170, and/or accessory 180 have been altered since transmission.

While transmitting parameters, initializer 100 may further provide communication parameters to enable gun 160, accessory 170, and accessory 180 to communicate with each other. As discussed above, the gun identifier of gun 160 and the identifiers of accessories 170 and 180 may be used to establish communication between controller 370 of gun 160 and controllers 570 respectively of accessory 170 and 180 (e.g., associated accessories). Communication may be established such that gun 170, accessory 170, and accessory 180 communicate with each other, but not with any other gun and/or accessory.

Communication between a gun and its associated accessories may be established using a cluster identifier. Initializer 100 may provide gun 160, accessory 170, and accessory 180 each with a unique cluster identifier. The cluster identifier may be used as a portion of a conventional communication protocol (e.g., MAC address, packet ID) to send and receive information only between gun 160, accessory 170, and/or accessory 180. Gun 160, accessory 170, and accessory 180 may further ignore information lacking the assigned cluster identifier.

For example, initializer 100 may assign gun 160 and accessories 170 and 180 a cluster identifier to form cluster 930. Initializer 100 may further assign cluster identifiers to gun 910, accessory 912 and accessory 914 to form cluster 930 and gun 920 and accessories 922 and 924 a cluster identifier to form cluster 950. The gun and accessories of cluster 930 may communicate with each other, but not with the guns and accessories of clusters 932 and 950. The guns and accessories of each cluster may communicate with each other, but not with the guns and accessories of other clusters.

An initializer may further assign a team identifier to one or more clusters. A team identifier may permit some form of communication between the clusters assigned the same team identifier. Communication may include receiving all communications from all equipment assigned to the same team regardless of cluster. Communication may include some level of cooperation between clusters and the equipment of each cluster. In one implementation, initializer 100 assigns clusters 930 and 932 the same team identifier to form team 940. Initializer 100 further assigns cluster 950 with a different team identifier to form team 960.

In another method for providing parameters, an initializer communicates only with guns and not with accessories. In an implementation, initializer 700 communicates with gun 160, but not with accessory 170 and 180. Initializer 100 provides parameters to gun 160 as discussed above. Gun 160 detects accessories and provides parameters to the accessories. Gun controller 370 performs a function of gun 160 in accordance with the parameters provide by initializer 700 as describe above. Accessory controllers 370 perform an operation of their respective accessories in accordance with parameters provided by gun 160.

Initializer 700 does not control operation interface 360 of gun 160. Processing circuit 110 of initializer 700 does not perform a function of gun 160. Initializer 700 does not control the operation interfaces 560 of accessory 170 and 180 respectively. Processing circuit 110 of initializer 700 does not perform a function of accessory 170 and/or 180.

As discussed above, gun 160 may detect and provide a presentation all available accessories to a user on display 330. Processing circuit 310 may receive an accessory identifier from each available accessory. Processing circuit 310 may present each accessory identifier for selection by a user. A user may visual inspect an accessory for the accessory's identifier. A user may select the accessory identifier for desired accessories as the identifier is presented on display 330 of gun 160 to associate an accessory with gun 160.

For example, a user would visually inspect an accessory (e.g., label on accessory, display 530) to discover the accessory identifier for accessory 170 and 180. The user would locate accessory identifiers for accessories 170 and 180 on display 330 and operate control 340 to select the identifiers for accessories 170 and 180. Selection associates accessories 170 and 180 with gun 160. For example, accessory identifiers may be presented on display 330 as a list. Selection may be accomplished using a control 340 proximate to each identifier on display 330 or by touching the identifier present on a touch screen display.

Gun 160 provides parameters to accessories 170 and 180. Gun 160 may provide parameters to an accessory as discussed above with respect to an initializer. Gun 160 may verify the consistency of parameters sent to each accessory 170 and 180 as discussed above. Gun 160 may verify the consistency of the parameters used by gun 160, accessory 170, and 180 for consistent cooperation as discussed above.

In another implementation, a user provides parameter values for gun 160 and/or accessories 170 and 180 to gun 160 via control 340. Gun 160 provides parameters to accessories 170 and 180 as described above. Processing circuit performs an operation of gun 160 in accordance with the parameters provided by the user. Accessory controllers 370 perform an operation of their respective accessories in accordance with parameters provided by gun 160.

In another implementation, initializer 800 is positioned proximate to entrance 810 of playing field 812. As each player carries paintball equipment past initializer 800 en route to entrance 810, initializer 800 detects each gun and/or accessories. Initializer 800 provides parameters to guns and/or accessories as described above.

An initializer may determine which accessories are associated with a gun. For example, initializer 800 may use received signal strength to detect accessories proximate to a gun. Initializer 800 may form a cluster of the gun and the proximate accessories. In another example, a user may identified the gun and accessories that for a cluster. Initializer 800 may receive gun and accessory identifiers from all available guns and accessories (e.g., within communication range), provide a presentation of each identifier on display 130, and receive instructions from a user via controls 140 to associate a gun and one or more accessories to form a cluster.

An area around entrance 810 may be established to improve transfer of parameters from initializer 800 to guns and accessories and/or for forming clusters. A volume marked 820 may be designated as a restricted area. User access to restricted area 820 may be controlled such that a singled user and the paintball equipment of that user are positioned inside restricted area 820 at any one time. The volume of restricted area 820 may be established to minimize communication interference from paintball equipment outside of restricted area 820 thereby permitting initializer 800 to provide parameters to a gun and/or accessories without interference from other paintball equipment. Access to restricted area may be controlled by gate 830. Restricted area 820 may further be constructed of a material that shields wireless communication between initializer 800 and paintball accessories positioned inside restricted area 820 from paintball equipment positioned outside of restricted area 820. An initializer may for a cluster of a gun and any accessories positioned within restricted area 820.

Volume requirements of restricted area 820 may be decreased by decreasing a range of wireless communication of initializer 800, paintball guns, and paintball accessories. In one implementation, the range of wireless communication is approximately 18 inches, thus as users pass by initializer 800 in single file, initializer provides parameters to the paintball equipment of each user without interference from the paintball equipment of other users.

Figure 10:
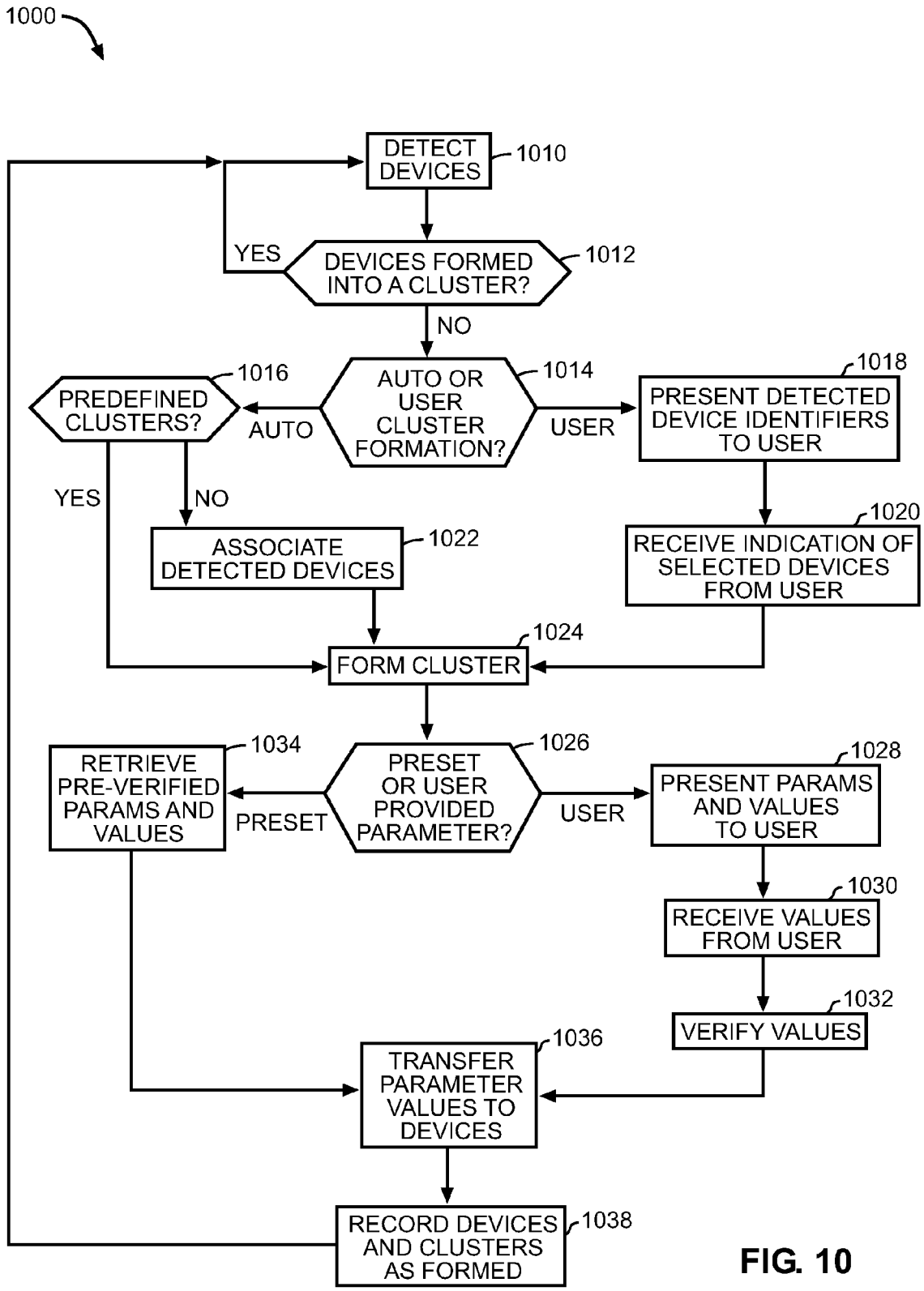
FIG. 10 is a method, according to various aspects of the present invention, performed by the electronic device of FIG. 1.
Figure 11:
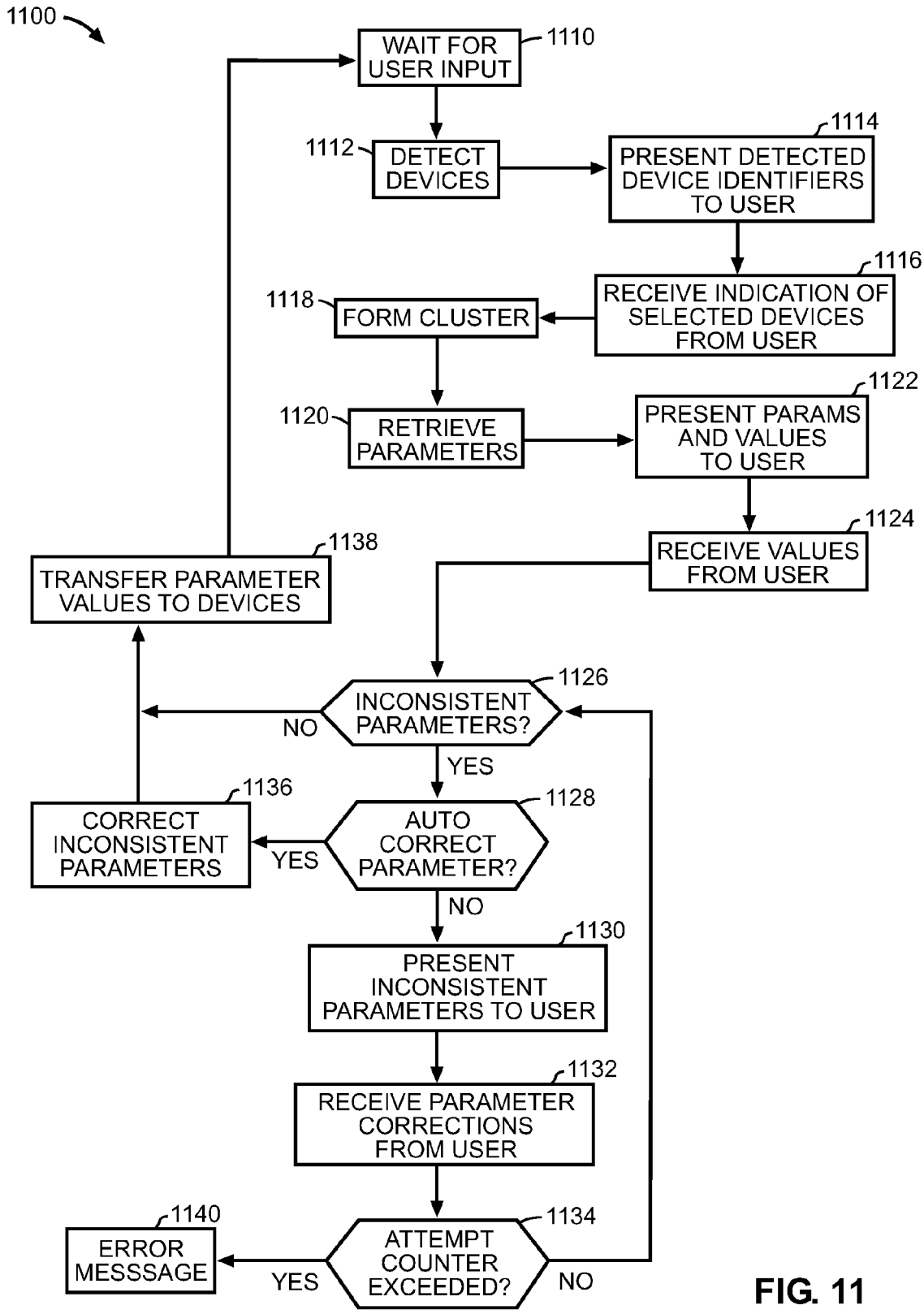
FIG. 11 is an other method, according to various aspects of the present invention, performed by the electronic device of FIG. 1.
Figure 12:
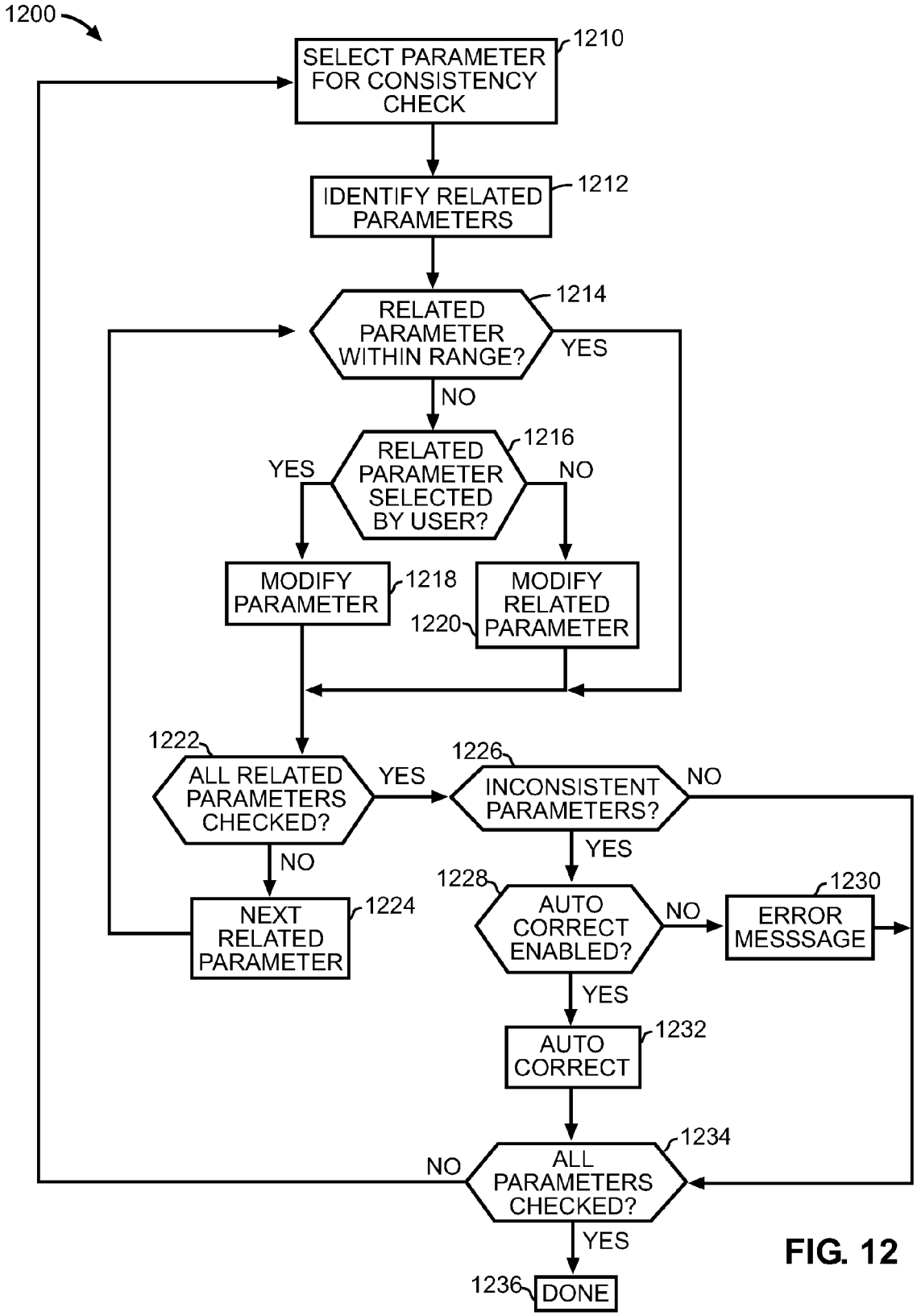
FIG. 12 is an other method, according to various aspects of the present invention, performed by the electronic device of FIG. 1.

Methods performed by an initializer and/or a gun controller that performs the functions of an initializer for forming a cluster, providing parameters, verifying (e.g., checking) parameter values, presenting parameter values to a user, receiving parameter values from a user, making parameters consistent (e.g., correcting), checking for inconsistent parameters, and providing notice of inconsistent parameters include all or part of the procedures (e.g., steps, functions) of methods 1000, 1100, and 1200 shown in FIGS. 10-12.

Cluster formation may be preformed by an initializer (e.g., automatic) or a user (e.g., manual). An initializer may detect devices. Detected devices may be assigned to a cluster by the initializer or a user. An initializer, as discussed above, may provide parameters to a gun and/or accessories of a cluster.

In one implementation, method 1000 includes functions 1010-1038. An initializer performs function 1010 to detect devices. Detection includes communicating wirelessly with guns and/or accessories as described herein. An initializer may receive gun and/or accessory identifiers, as discussed above, to detect a device.

An initializer performs function 1012 to detect whether detected devices (e.g., guns, accessories) are already formed into a cluster. A cluster identifier may be used to detect whether a cluster is formed as described herein.

An initializer performs function 1014 to detect whether cluster formation is performed by an initializer or by a user. Automatic cluster formation may be performed by an initializer. An initializer may include a database that describes predefined clusters. A database may store gun and/or accessory identifiers. A cluster identifier may be assigned to a gun and/or accessories and stored in the database. Associating (e.g., assigning) a cluster to a gun and/or accessory identifier identifies a cluster. Providing the cluster identifier to the gun and/or accessories forms the cluster for coordinated operation. An initializer performs function 1016 to detect whether the initializer includes predefined clusters in a database for guns and/or accessories. When an initializer detects devices that are part of a predefined cluster, the initializer assigns the cluster identifier to the detected devices.

When an initializer does not include a predefined cluster database, an initializer may perform function 1022 to associate all of the devices presently detected as a cluster. Associating presently detected devices operates to form clusters more effectively when the initializer detects only the devices that should be associated together into a cluster. An area such as area 820, as discussed above, may facilitate cluster formation when an initializer forms clusters of all presently detected devices.

An initializer may detect that a user will select devices for a cluster. Upon detecting that a user will participate in forming a cluster, an initializer performs function 1018 to present to the user all of the devices presently detected. An initializer may provide a presentation of a list of identifiers on a display. A user may select specific identifiers from a list for forming a cluster. User participation facilitates cluster formation when an initializer detects many devices and does not have predefined clusters. A user may review a list of detected devices to find those devices that the user would like to form a cluster. Cluster formation may include the steps performed by a user as discussed above.

An initializer may perform function 1020 to receive selection of devices from a user to form a cluster. An initializer may provide information to assist user section. Information may include an identifier, a manufacturer name, a model name, and proximity to the initializer. A user may operate a control to select a device as discussed above.

An initializer performs function 1024 to form a cluster. A cluster may be formed by providing a cluster identifier to a gun and/or accessories as discussed above.

An initializer may provide parameters to a gun and/or accessories of a cluster. An initializer may provide preset parameters or receive user parameters. An initializer may perform function 1026 to detect whether the initializer should provide preset parameters or receive user parameters.

Although not shown in FIG. 10, upon detecting that devices already form a cluster, an initializer may skip performing functions 1012-1024 and perform functions 1026-1038 to provide parameters to a gun and/or accessories of a cluster.

An initializer, upon detecting that it should provide preset parameters, performs function 1034 to retrieve parameters for the gun and/or accessories. An initializer may use a gun and/or accessory parameter library as discussed above to retrieve parameters for the gun and/or accessories. Retrieving preset parameters for a particular gun and/or accessory may include detecting parameters that are consistent for the gun and/or accessories singly and in combination. Preset parameters may include parameters that have been previously verified to be consistent for any combination of guns and/or accessories.

An initializer, upon detecting that user will provide parameters, performs function 1028 to present parameters and parameter values to a user. A presentation of parameters and parameters values may be performed as discussed above. An initializer may present parameters and parameter values on a display.

An initializer performs function 1030 to receive parameter values from a user. Receiving parameter values from a user may include detecting an operation of a control as discussed above.

Upon receiving values from a user, an initializer performs function 1032 to verify (e.g., check) whether the values are consistent for the devices singly or in combination. Checking the consistency of a parameter may include performing some or all of the functions of method 1200.

Upon receiving the parameters for one or more devices, an initializer performs function 1036 to transfer the parameter values to the one or more devices. Transferring parameter values may include wireless communication as discussed above.

An initializer may perform function 1038 to form a record of the devices formed into a cluster. An initializer may store a record of the devices of a cluster. A record of devices formed into a cluster may be stored in a database for later use as a predefined cluster. An initializer may provide the record of a cluster to another device.

An initializer may permit a user to have complete or nearly complete control of forming clusters and/or providing parameter values to a device. In one implementation, an initializer performs method 1100 to permit a user to form a cluster and/or provide parameters. An initializer may perform a function of correcting inconsistent parameters or provide an opportunity to a user to correct inconsistent parameters.

An initializer may perform all or some of the functions of method 1100. An initializer performs function 1110 to wait until a user indicates that the user wishes to form a cluster and/or provide parameters.

An initializer may perform function 1112 to detect devices as discussed with respect to function 1010. An initializer may perform functions 1114, 1116, and 1118 as discussed with respect to functions 1018, 1020, and 1024 to identify detected devices to a user, to receive a selection of detected devices from a user, and to form a cluster. Although not shown in FIG. 11, an initializer may perform functions 1110-1118 without performing functions 1120-1140 to form a cluster.

An initializer performs function 1120 to receive parameters for a gun and/or an accessory. Retrieving a parameter may include using a device identifier to retrieve a parameter from a parameter library. Retrieving a parameter may include receiving a parameter from a device.

An initializer performs functions 1122 and 1124 as discussed with respect to functions 1018 and 1020 to present parameters and parameter values to a user and to receive values from a user.

An initializer may perform functions 1126-1136 to determine whether the parameter values provided by a user are consistent. An initializer may further operate to automatically correct inconsistent values provided by a user.

An initializer performs function 1126 to detect whether any of the parameter values provide by a user are inconsistent with any other values. As discussed above, an initializer may detect inconsistent values that may affect an operation of a single device or the cooperation of many devices.

An initializer performs function 1128 to determine whether the initializer should correct inconsistent parameter values or whether the user should correct inconsistent parameter values. An initializer performs function 1136 to correct inconsistent parameter values. Function 1136 may include the functions performed by function 1034 to retrieve verified parameter values as discussed above.

An initializer performs functions 1130 and 1132 to present inconsistent parameter values to a user and to receive corrected parameter values from a user. Parameter and parameter values may be presented to a user in a manner consistent with functions 1018 or 1114 discussed above. An initializer may receive parameters and parameter values from a user consistent with functions 1020 and 1116 discussed above. Function 1130 may include presenting reasons to a user as to why a parameter is not consistent. Function 1130 may further provide information as to the parameter values that are inconsistent with the parameter being checked. An initializer may further provide a presentation of a range of consistent values.

An initializer may provide a user a number of tries to provide a consistent parameter. An initializer performs function 1134 to detect whether a user has exceeded the number of attempts allotted. An initializer performs function 1140 to provide a user with an error message in the event that the user provides inconsistent parameter values in excess of the number of attempts permitted.

After an initializer performs function 1126 and detects that no parameters are inconsistent or function 1136 to correct all inconsistent parameters, the initializer may perform function 1138 to transfer the parameter values to the devices. The operations performed by an initializer while performing function 1036 may include the operations performed while performing function 1036 as discussed above.

Function 1032 may include some or all of functions 1126-1136.

As discussed above, an initializer may verify whether the parameter values of a gun and/or accessories are consistent. In one implementation, an initializer performs some or all of the functions of method 1200 to check consistency of parameter values.

An initializer performs function 1210 to select a parameter for a consistency check. A parameter may include any parameter of a gun and/or accessories. Having selected a parameter, an initializer performs function 1212 to identify parameters related to the selected parameter. Parameters may be related in a variety of circumstances. Parameters may be related when a controller uses both parameters to perform a single function or a series of related functions. Parameters may be related when the permissible range of values for one parameter depends on the range of values for one or more other parameters. Performance of function 1212 identifies all parameters, which may include zero or more parameters that are related to the selected parameter.

An initializer performs function 1214 to determine whether the value of the related parameters presently being checked is within an acceptable range based on the value of the selected parameter. A range of acceptable values may be stored in a parameter library. A library may include templates of acceptable values with respect to the value of one or more other parameters singly or in combination.

When a related parameter value is not within range, either the value of the selected parameter or the value of the related parameter may be modified. An initializer may perform function 1216 to determine whether the selected parameter or the related parameter should be modified. Function 1216 determines whether the parameter value being verified was provided by a user. In the event that a user provides a parameter, the initializer may assume that the value selected by the user is important. If the user selected the value being verified, the initializer will try to preserve the value specified by the user and adjust the values of the related parameters to achieve consistency.

An initializer performs function 1218 to modify the value of the selected parameter and function 1220 to modify the value of the related parameter.

In another implementation, function 1216 is omitted and either function 1218 or 1220, but not both, is performed each time a parameter value is modified.

After checking the value of a related parameter and possibly modifying the value of the selected parameter or the value of the related parameter, the initializer performs function 1222 to determine whether all related parameters have been verified or whether other related parameters must be checked. An initializer performs function 1224 to select the next related parameter for verification by functions 1214-1220.

Once the parameter values of all related parameters has been verified, an initializer performs function 1226, as discussed above with respect to function 1126, to determine if any parameters are inconsistent. If no parameters are inconsistent, the initializer performs function 1234 to determine if all parameters have been checked. If all parameters have been checked, the initializer performs function 1236 to complete the verification process. If all parameters have not been checked, the initializer returns to function 1210 to check another parameter.

If inconsistent parameters are found, an initializer performs function 1228 to determine whether the initializer is permitted to automatically correct inconsistent parameter values. If auto correction is not permitted, the initializer performs function 1230 to provide an error message to the user to advise the user of the inconsistent parameter value. The initializer may then moves to function 1234 to continue checking.

If the initializer is permitted to perform automatic correction of inconsistent parameter values, the initializer performs function 1232 to correct the parameter values that are inconsistent. Performance of function 1232 may include performance of some or all of the operations of function 1034 and/or 1136.

Function 1126 may include some or all of functions 1210-1236.

The methods and functions discussed above may be performed by initializer 100, 700, 800, and/or 900. Gun controller 370 while performing the functions of an initializer may perform the methods and functions discussed above.

The term "parameter" may be construed to include "parameter value" when inclusion broadens the disclosure. For example, the phrase "the user provides a parameter" may be construed to mean the a user provided a parameter and/or a parameter value.

Further disclosure, according to aspects of the present invention, includes the below.

1. A method performed by an electronic device for associating a paintball gun with one or more accessories, the method comprising:

receiving a unique identifier from at least one gun and one or more accessories respectively;

presenting a presentation on a display of the electronic device of the unique identifiers to a user;

receiving from the user via manual operation of a control of the electronic device indicia of selecting one gun and one or more accessories; and providing zero or more parameters to the selected gun and one or more accessories; wherein:

the electronic device does not perform an operation of the gun; and the electronic device does not perform an operation of the accessory.

2. A method performed by a controller for a paintball gun for associating a paintball gun with one or more accessories, the method comprising:

receiving a unique identifier from one or more accessories respectively;

presenting a presentation on a display of the controller of the unique identifiers to a user;

receiving from the user via manual operation of a control of the indicia of selecting one gun and one or more accessories; and providing zero or more parameters to the selected one or more accessories; wherein:

a processing circuit of the controller performs an operation of the paintball gun; and a processing circuit of a control of each accessory respectively performs an operation of the accessory in accordance with the zero or more parameters.

3. A method performed by an electronic device for associating a paintball gun with one or more accessories, the method comprising:

providing a unique cluster identifier to a gun and one or more accessories while positioned within a restricted area; and providing zero or more parameters to the gun and the one or more accessories while positioned within the restricted area.

4. A method performed by a controller for a paintball gun, the method comprising:

wirelessly receiving a first parameter;

wirelessly transmitting a second parameter, the second parameter for controlling an operation of a paintball accessory;

performing an operation of the paintball gun in accordance with the first parameter.

5. The method of claim 4 wherein transmitting the second parameter comprises wirelessly receiving the second parameter.

6. The method of claim 4 wherein transmitting the second parameter comprises receiving the second parameter from a memory.

7. The method of claim 4 wherein transmitting the second parameter comprises receiving the second parameter via an operation of a control by a user.

8. The method of claim 4 wherein transmitting the second parameter comprises detecting whether the operation of the paintball accessory in accordance with the second parameter is consistent with the operation of the paintball gun in accordance with the first parameter.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below.

What is claimed is:

1. A method performed by an electronic device for providing a first parameter and a second parameter to a paintball gun and a paintball accessory, the method comprising:

wirelessly providing the first parameter to the paintball gun, the first parameter for controlling an operation of the paintball gun; and wirelessly providing the second parameter to the paintball accessory, the second parameter for controlling an operation of the paintball accessory; wherein:

the paintball gun performs the operation of the paintball gun in accordance with the first parameter;

the paintball accessory performs the operation of the paintball accessory in accordance with the second parameter;

the electronic device does not perform the operation of the paintball gun; and the electronic device does not perform the operation of the paintball accessory.

2. The method of claim 1 further comprising detecting whether the operation of the paintball gun in accordance with the first parameter is consistent with the operation of the paintball accessory in accordance with the second parameter.

3. The method of claim 1 wherein the second parameter controls the operation of the paintball accessory in accordance with the first parameter.

4. An electronic device for providing a first parameter for a provided paintball gun and a second parameter for a provided paintball accessory, the electronic device comprising:

a processing circuit;

a memory that stores the first parameter and the second parameter; and a wireless transceiver; wherein:

the wireless transceiver transmits the first parameter, the first parameter for controlling an operation of the paintball gun;

the wireless transceiver transmits the second parameter, the second parameter for controlling an operation of the paintball accessory;

the processing circuit does not perform the operation of the paintball gun; and the processing circuit does not perform the operation of the paintball accessory.

5. The electronic device of claim 4 wherein the processing circuit detects whether the operation of the paintball accessory in accordance with the second parameter is consistent with the operation of the paintball gun in accordance with the first parameter.

6. The electronic device of claim 4 wherein the second parameter controls an operation of the paintball accessory in accordance with the first parameter.

7. The electronic device of claim 4 wherein:

the wireless transceiver receives an identifier from the paintball gun; and the processing circuit retrieves the first parameter from the memory in accordance with the identifier.

8. The electronic device of claim 4 wherein:

the wireless transceiver receives an identifier from the paintball accessory; and the processing circuit retrieves the second parameter from the memory in accordance with the identifier.

9. The electronic device of claim 4 further comprising a display and a control, wherein:

the processing circuit provides a presentation of a plurality of parameters on the display; and a user operates the control to select the first parameter.

10. The electronic device of claim 4 further comprising a display and a control, wherein:

the processing circuit provides a presentation of a plurality of parameters on the display; and a user operates the control to select the second parameter.

11. The electronic device of claim 4 further comprising a control, wherein a user operates the control to select the first parameter and the second parameter.

12. The electronic device of claim 11 wherein the processing circuit detects whether the operation of the paintball accessory in accordance with the second parameter is consistent with the operation of the paintball gun in accordance with the first parameter.

13. A controller for a paintball gun that receives a first parameter and provides a second parameter, the controller comprising:

a processing circuit;

a wireless transceiver; wherein:

the wireless transceiver wirelessly receives the first parameter via a wireless transmission from a provided wireless device;

the wireless transceiver wirelessly transmits the second parameter, the second parameter for controlling an operation of a provided accessory;

the processing circuit performs an operation of the paintball gun in accordance with the first parameter; and the paintball accessory performs an operation of the paintball accessory in accordance with the second parameter.

14. The controller of claim 13 further comprising a memory, wherein the memory stores the second parameter.

15. The controller of claim 13 further comprising a memory, wherein:

the memory stores a plurality of parameters for controlling the operation of the paintball accessory; and the processing circuit selects the second parameter from the plurality of parameters in accordance with the first parameter.

16. The controller of claim 13 further comprising a control, wherein the control receives the second parameter via operation of the control by a user.

17. The controller of claim 13 wherein the wireless transceiver wirelessly receives the second parameter via a wireless transmission from the wireless device.

18. The controller of claim 13 wherein the wireless transceiver receives the second parameter for transmission from the processing circuit.

19. The controller of claim 13 wherein the wireless transceiver wirelessly receives the second parameter for transmission.

20. The controller of claim 13 wherein the processing circuit detects whether the operation of the paintball accessory in accordance with the second parameter is consistent with the operation of the paintball gun in accordance with the first parameter.

* * * * *